US006464545B2

(12) United States Patent
Yano

(10) Patent No.: US 6,464,545 B2
(45) Date of Patent: Oct. 15, 2002

(54) ELECTRICAL DEVICE CONNECTION TERMINAL

(75) Inventor: Keisuke Yano, Kyoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 10/107,326

(22) Filed: Mar. 28, 2002

(65) Prior Publication Data

US 2002/0142671 A1 Oct. 3, 2002

(30) Foreign Application Priority Data

Mar. 30, 2001 (JP) ..... 2001-100682

(51) Int. Cl.[7] ..... H01R 4/48
(52) U.S. Cl. ..... 439/828; 439/441
(58) Field of Search ..... 439/828, 835, 439/721, 441

(56) References Cited

U.S. PATENT DOCUMENTS 5,127,846 A * 7/1992 Kollmann ..... 439/441
5,679,021 A * 10/1997 Kramer ..... 439/789
5,816,867 A * 10/1998 Davidsz et al. ..... 439/828
5,860,637 A * 1/1999 Mandon ..... 267/164
6,126,494 A * 10/2000 Fuchs et al. ..... 439/441
6,146,486 A * 11/2000 Ozaki et al. ..... 156/244.11

FOREIGN PATENT DOCUMENTS

| | | | |
|---|---|---|---|
| DE | 196 29 563 | 1/1998 | |
| JP | 6-216935 | 8/1994 | ..... 12/54 |
| JP | 11-055486 | 2/1999 | ..... 1/32 |

* cited by examiner

*Primary Examiner*—Brian Sircus
*Assistant Examiner*—Phuong KT Dinh
(74) *Attorney, Agent, or Firm*—Morrison & Foerster LLP

(57) ABSTRACT

The present invention provides an electrical device connection terminal capable of preventing improper insulation owing to lead wire chips being dropped and built up. To attain this feature, a side wall 26 for separating a lead wire holding portion 25 from a lead fitting 43 is projected on the bottom face fringe of the lead wire holding portion 25 so as to be adjacent to one side of the lead fitting 43.

5 Claims, 25 Drawing Sheets

ELECTRICAL DEVICE CONNECTION TERMINAL

TECHNICAL FIELD

The present invention relate to an electrical device connection terminal, and more particularly to an electrical device connection terminal having a socket function for electrically connecting electrical devices, such as relays and timers, to external circuits via lead wires.

PRIOR ART

A conventional electrical device connection terminal is disclosed in DT-OS (DE 19629563 A1), for example.

More specifically, in the electrical device connection terminal shown in FIG. 4 of the above-mentioned publication, for example, a clamp spring installed on one side of one end of a lead fitting is mounted in a clamp spring accommodation portion provided in a base. Furthermore, in the electrical device connection terminal, a lead wire is inserted into the connection hole in the clamp spring by operating the clamp spring using a screwdriver or the like. Hence, the lead wire is held between the lead fitting and the clamp spring by the force of the clamp spring, thereby establishing electrical connection. Because of this configuration, if the lead wire is forcibly pulled out from the clamp spring, a part of the lead wire may be broken off, and lead wire chips may drop.

In particular, in the above-mentioned electrical device connection terminal, the lead fitting is mounted in the base afterwards. Hence, a gap may occur between the base and the lead fitting owing to variations in the accuracy of components and the accuracy of assembly. The lead wire chips are apt to get into the gap. In addition, if vibration and external forces are applied to the base, the base may be deformed elastically, whereby the gap may become wider, and the lead wire chips having built up may drop downward and may build up further. As a result, a downwardly disposed lead fitting may be short-circuited to another upwardly disposed lead fitting, thereby being in danger of causing improper insulation.

Furthermore, in a general electrical device connection terminal, its base is fitted into its case so as to be covered. Hence, it is inevitable that a gap occurs between the outside face of the base and the inside face of the case. Therefore, lead wire chips may drop through the gap and build up. As a result, a downwardly disposed lead fitting may be short-circuited to another upwardly disposed lead fitting, thereby being in danger of causing improper insulation.

In consideration of the above-mentioned problems, the present invention is intended to provide an electrical device connection terminal capable of preventing improper insulation owing to lead wire chips having been broken off lead wires and then dropped and built up.

SUMMARY OF THE INVENTION

An embodiment of the present invention is an electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with the clamp spring accommodation portions and the lead wire holding portions are provided on the side face of the base; nearly L-shaped lead fittings provided with a clamp spring on one side of the upper end of each lead fitting are press-fitted into the L-shaped grooves sideways; by inserting lead wires inserted through the lead wire insertion holes into the connection holes in the clamp springs while operating the clamp springs with an operation rod inserted into each of the operation rod insertion holes, each of the lead wires is held between the lead fitting and the clamp spring by the spring force of the clamp spring to establish electrical connection, the electrical device connection terminal is characterized in that a side wall for separating the lead wire holding portion from the lead fitting is projected on the bottom face fringe of the lead wire holding portion so as to be adjacent to one side of the lead fitting.

Hence, in accordance with the present invention, even if a part of a lead wire is broken and lead wire chips drop, the lead wire chips build up inside the lead wire holding portion separated by the side wall. For this reason, even if a gap occurs between the lead fitting and the base, the lead wire chips do not drop through the gap, thereby preventing improper insulation owing to the dropping and build up of the lead wire chips.

Another embodiment of the present invention may be an electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with the clamp spring accommodation portions and the lead wire holding portions are provided on the side face of the base; nearly L-shaped lead fittings provided with a clamp spring on one side of the upper end of each lead fitting are press-fitted into the L-shaped grooves sideways; by inserting lead wires inserted through the lead wire insertion holes into the connection holes in the clamp springs while operating the clamp springs with an operation rod inserted into each of the operation rod insertion holes, each of the lead wires is held between the lead fitting and the clamp spring by the spring force of the clamp spring to establish electrical connection, the electrical device connection terminal is characterized in that projection portions are disposed on the inside faces of a case to be fitted with the base so as to be fitted into and block the side openings of the lead wire holding portions formed in the base.

Hence, in accordance with the present invention, lead wire chips do not drop from the side openings of the lead wire holding portions along the inside faces of the case, thereby preventing improper insulation owing to the drop and buildup of the lead wire chips.

Still another embodiment of the present invention may be an electrical device connection terminal wherein projection portions are formed on the inside faces of the case to be fitted with the base so as to be fitted into and block the side openings of the lead wire holding portions formed in the base, and the projection portions are fitted into the upper ends of the side walls of the lead wire holding portions so as to support the side walls.

In accordance with the present invention, the projection portions formed on the case to block the side openings of the lead wire holding portions are fitted into the upper ends of the side walls forming the lead wire holding portions so as to support the side walls. Hence, the side walls are reinforced and strengthened.

Still another embodiment of the present invention may be an electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with the clamp spring accommodation portions and the lead wire holding portions are provided on the side face of the base; nearly L-shaped lead fittings provided with a clamp spring on one side of the upper end of each lead fitting are press-fitted into the L-shaped grooves sideways; by inserting lead wires inserted through the lead wire insertion holes into the connection holes in the clamp springs while operating the clamp springs with an operation rod inserted into each of the operation rod insertion holes, each of the lead wires is held between the lead fitting and the clamp spring by the spring force of the clamp spring to establish electrical connection, the electrical device connection terminal is characterized in that the lead wire holding portion is enclosed with side walls each having a flat and nearly square shape and projecting along the bottom face fringe of the lead wire holding portion.

In accordance with the present invention, the lead wire holding portion disposed in the base and being capable of accommodating lead wire chips is enclosed with the side walls in four directions. For this reason, lead wire chips do not drop along the side face of the lead fitting and the inside faces of the case, thereby preventing improper insulation. Furthermore, it is not necessary to form projection portions on the inside faces of the case, whereby the design of the case is simplified.

Still another embodiment of the present invention may be an electrical device connection terminal wherein assembly-use hold holes formed near the upper end of the lead fitting are blocked by the side wall projecting along the bottom face fringe of the lead wire holding portion.

In accordance with the present invention, the assembly-use hold holes are blocked by the side wall enclosing the lead wire holding portion. For this reason, lead wire chips do not drop through the hold holes to the clamp spring accommodation portion adjacent to the lead fitting. Hence, improper insulation can be prevented more securely.

DETAILED DESCRIPTION OF THE PREFERRED EMBODIMENTS

Embodiments in accordance with the present invention will be described below referring to the accompanying drawings, FIG. 1 to FIG. 25.

Figure 1:
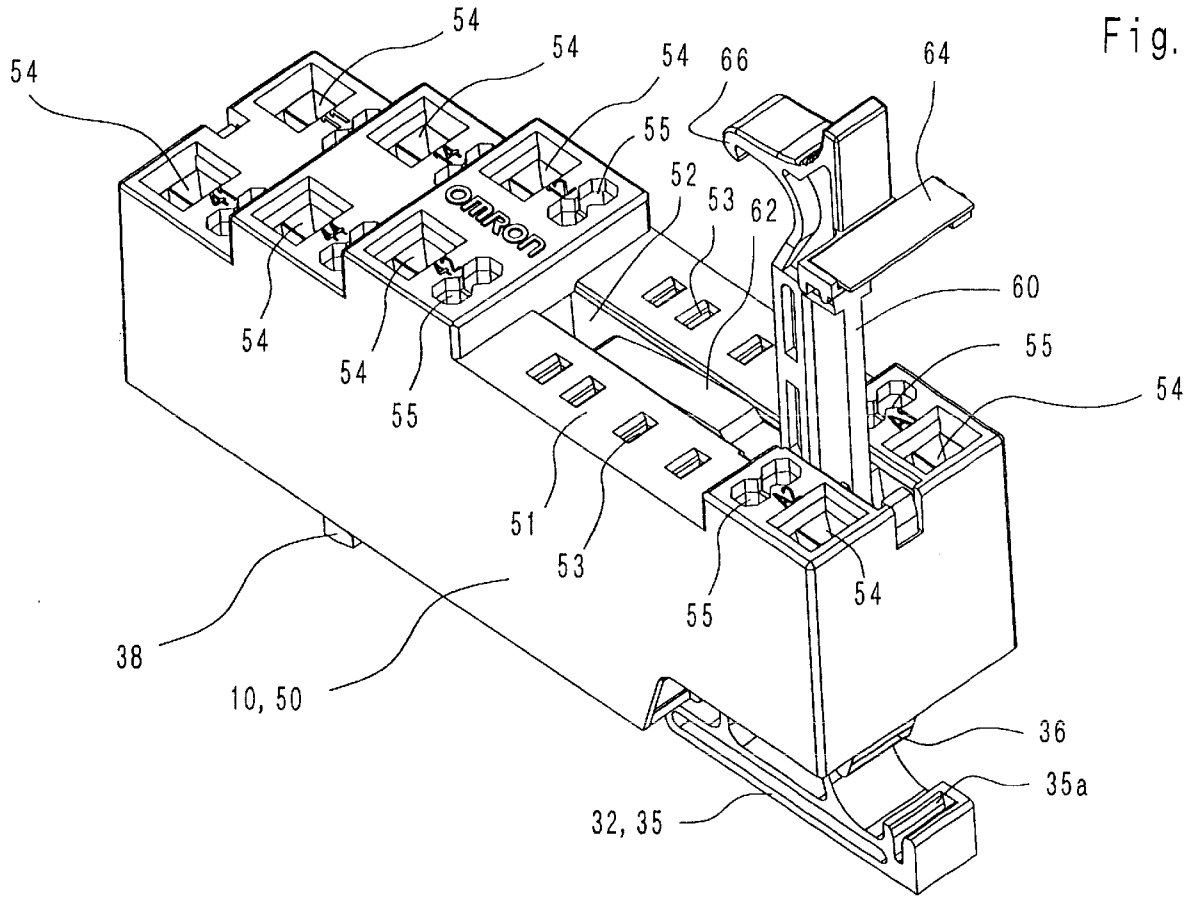
FIG. 1 is a perspective view showing an electrical device connection terminal in accordance with a first embodiment of the present invention.
Figure 2:
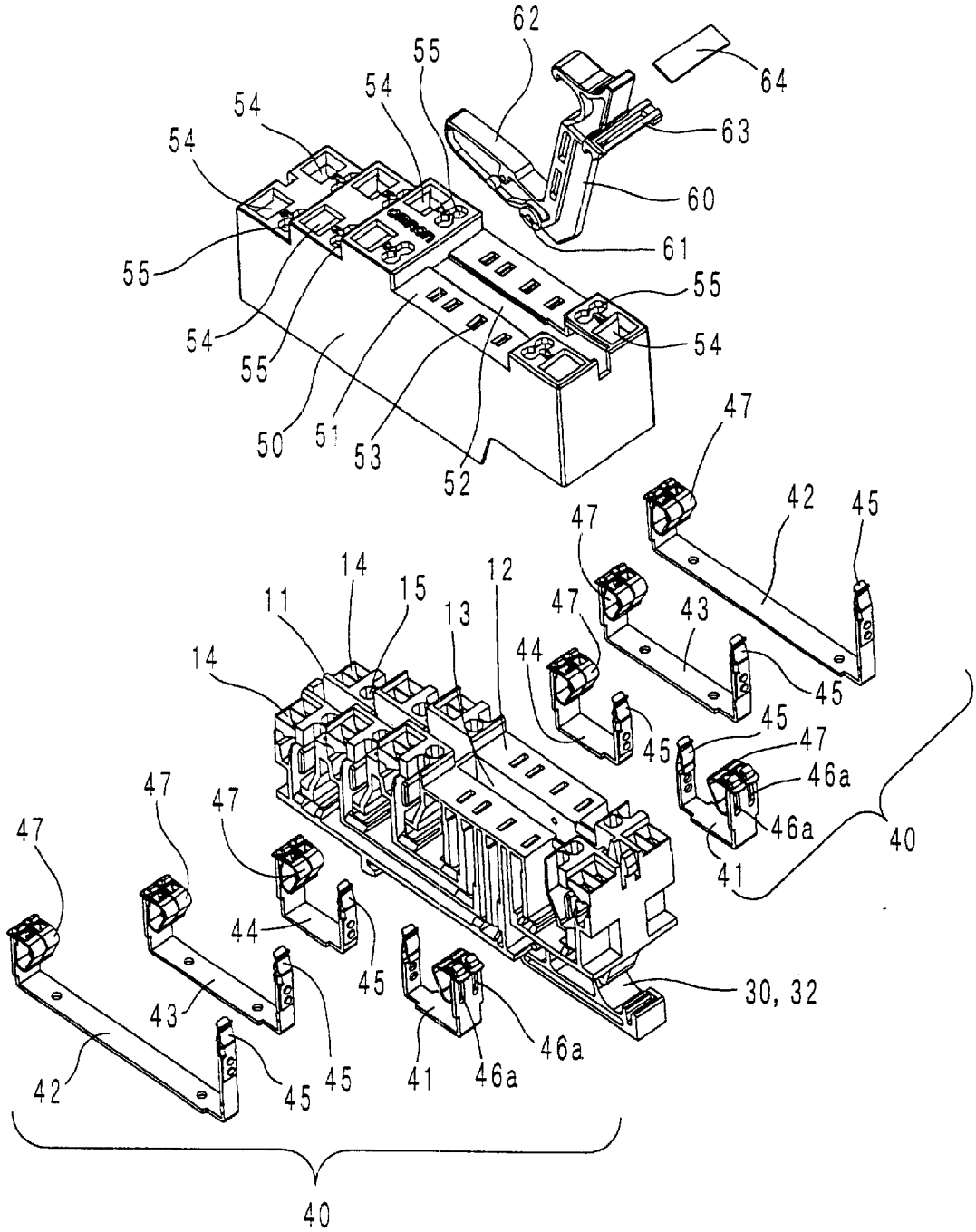
FIG. 2 is an exploded perspective view showing the electrical device connection terminal shown in FIG. 1.

An electrical device connection terminal 10 in accordance with a first embodiment of the present invention shown in FIG. 1 generally comprises a base 11, one set of right and left connection mechanism portions 40 and 40 mounted on both sides of the base 11, a case 50 fitted and integrated with the base 11, and a relay mounting/dismounting lever 60 rotatably mounted on one side of the upper face of the base 11, as clearly shown in FIG. 2, an exploded perspective view.

The base 11 is a resin-molded component integrated with a rail installation structure 30 on its bottom face. A recessed portion 12 on which a relay is mounted is formed at the upper intermediate portion of the base 11. The upper face on one side of the recessed portion 12 has a staircase-like shape. Furthermore, at the center of the recessed portion 12, an insertion groove 13 is formed so as to rotatably support a lever 60, described later.

Figure 3:
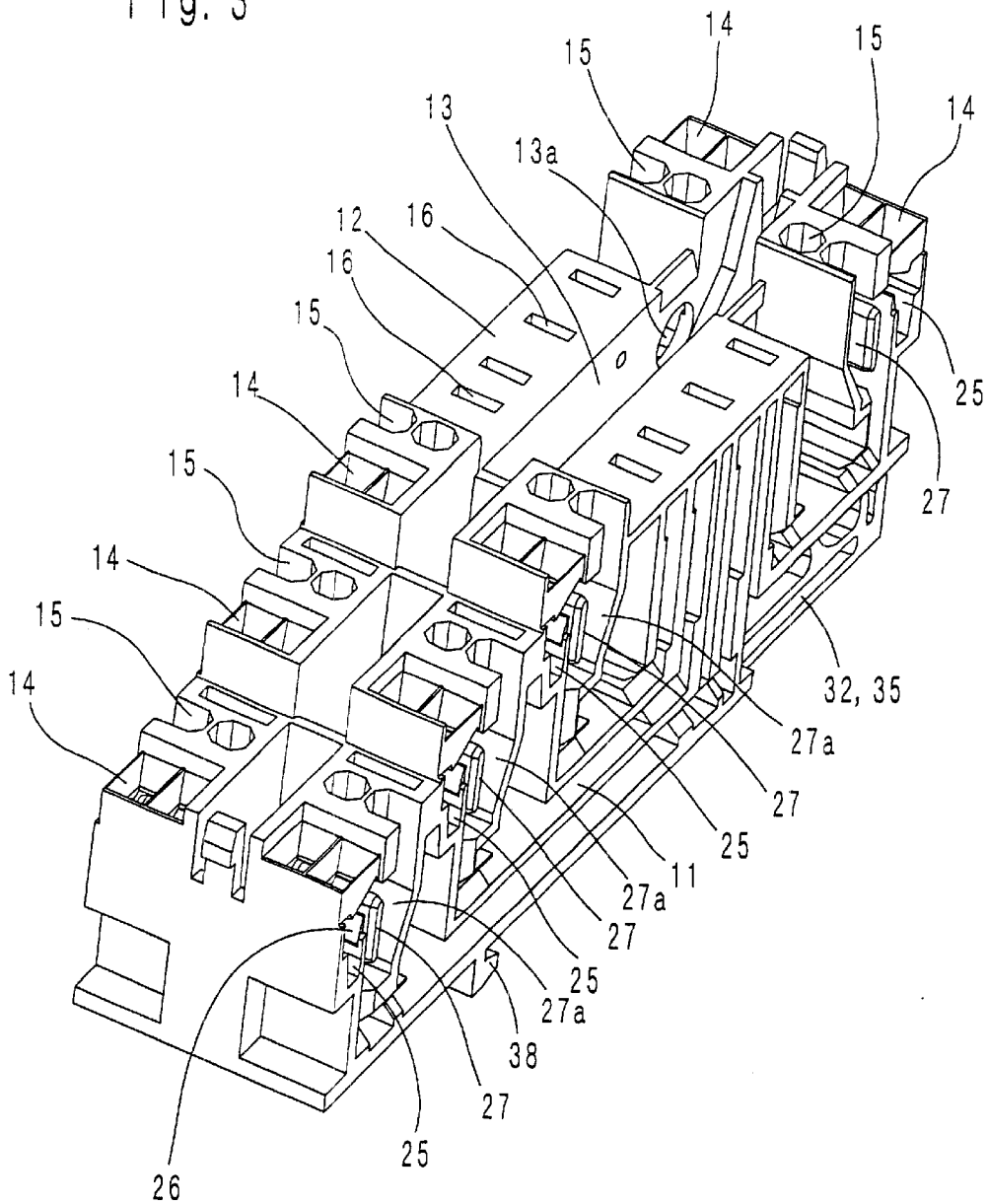
FIG. 3 is an enlarged perspective view showing the base shown in FIG. 2 at a different angle.
Figure 4:
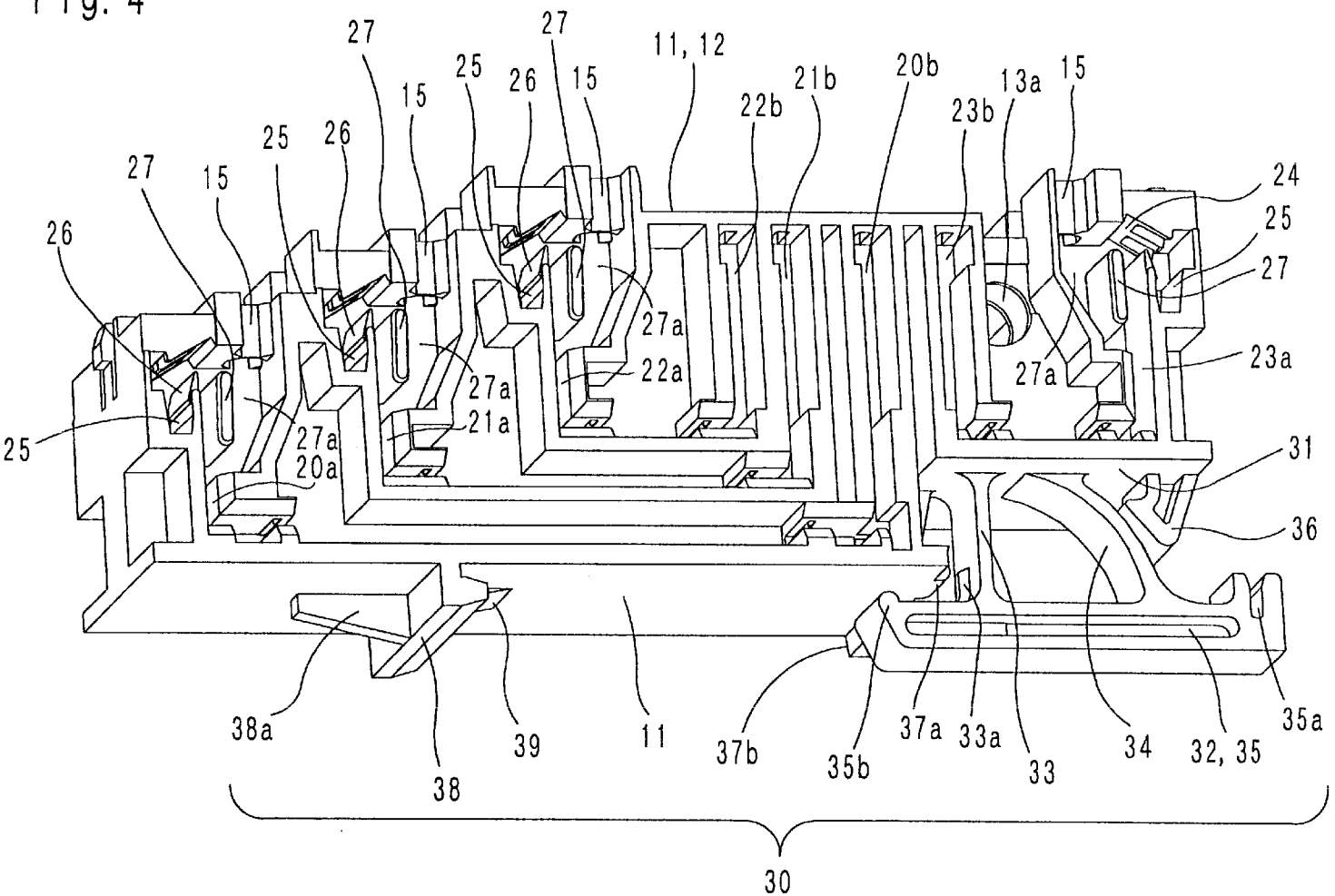
FIG. 4 is an enlarged perspective view showing the base shown in FIG. 2 from its lower side.

As shown in FIGS. 3 and 4, four sets of nearly L-shaped press-fit grooves 20*a*, 20*b*, 21*a*, 21*b*, 22*a*, 22*b*, 23*a* and 23*b* (one pair is being used as one set) are formed on both side faces of the base 11 so that the lead fittings of the connection mechanism portion 40, described later, can be press-fitted therein sideways. A pair of lead wire insertion holes 14 and 14 and a pair of operation rod insertion holes 15 and 15 are formed above the press-fit grooves 20*a*, 21*a*, 22*a* and 23*a*. On the other hand, a pair of terminal holes 16 and 16 is formed above the press-fit grooves 20*b*, 21*b*, 22*b* and 23*b*, respectively.

Figure 5A:
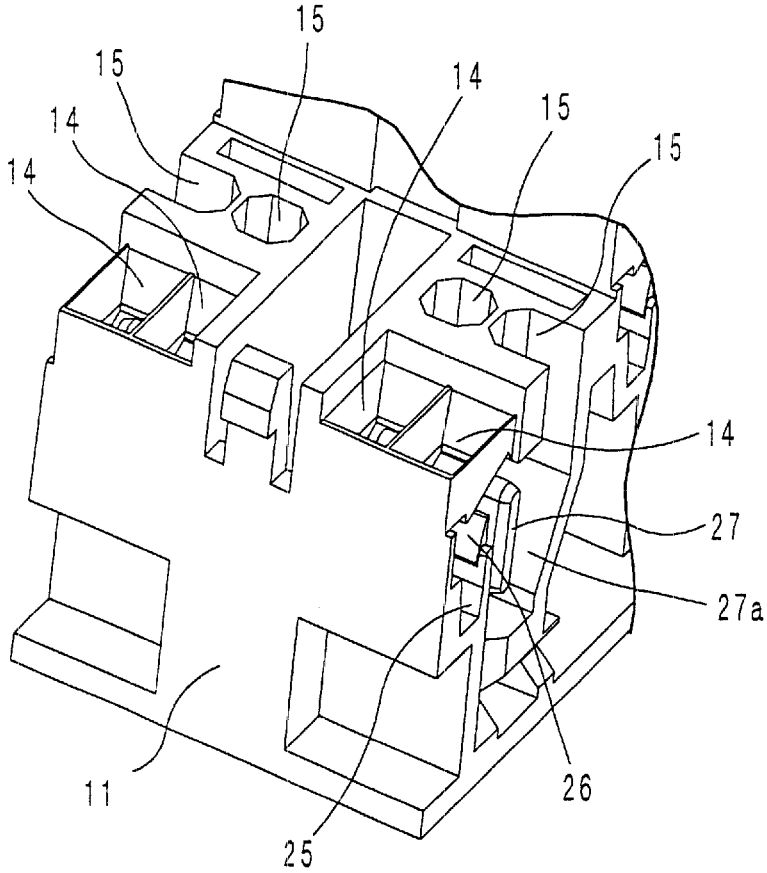
FIG. 5A is a partially enlarged view of the perspective view shown in FIG. 3.
Figure 5B:
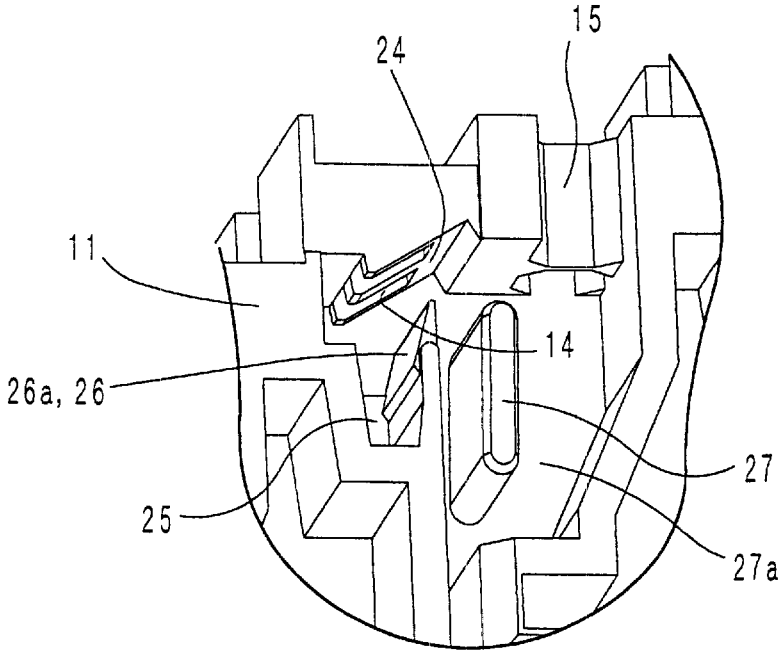
FIG. 5B is a partially enlarged view of the perspective view shown in FIG. 4.

A taper face 24 for preventing a lead wire from being pulled out is formed directly below the lead wire insertion hole 14 as shown in FIG. 5B. Furthermore, below the taper face 24, a partition wall 26 is projected so as to be adjacent to the lead fitting. A lead wire holding portion 25 nearly U-shaped in cross section is formed directly below the lead wire insertion hole 14. Hence, the lead wire holding portion 25 can accommodate lead wire chips produced when the lead wire is pulled out forcibly. Behind the partition wall 26, a clamp spring accommodation portion 27*a* is formed so as to communicate with the insertion hole 15. Inside the accommodation portion 27*a*, a stopper 27 for positioning one end of the lead fitting is projected so as to have a predetermined clearance from the partition wall 26. Hence, the one end of the lead fitting is held between the partition wall 26 and the stopper 27.

Not only the lead wire holding portion 25 disposed on one side of the lead fitting but also the clamp spring accommodation portion 27*a* disposed on the other side may also be formed so as to accommodate dropped lead wire chips as a matter of course. Furthermore, projection portions may be formed on the inside faces of the case 50, described below, to block all the openings on the sides of the lead wire holding portions 25 and the clamp spring accommodation portions 27*a*.

Figure 13:
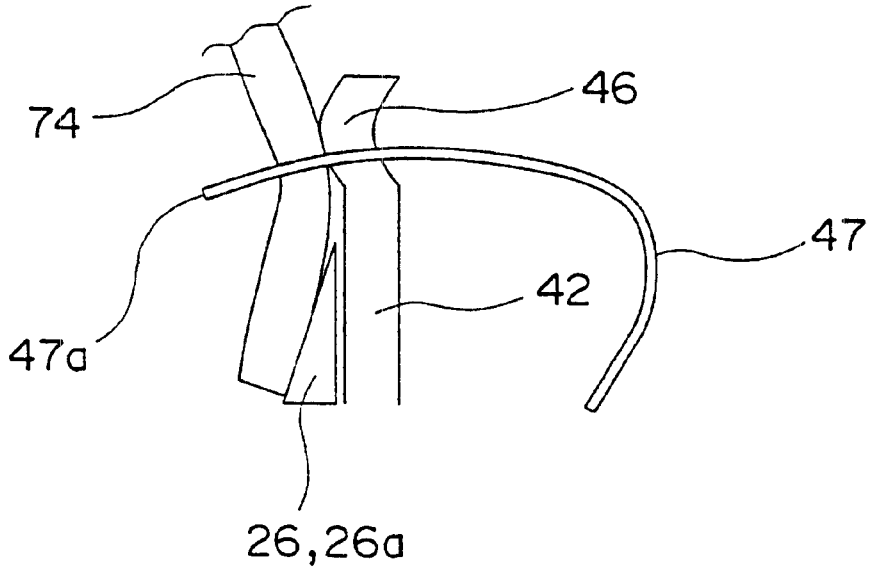
FIG. 13 is a partially sectional view showing another action of the clamp spring shown in FIG. 6.

Furthermore, the lead wire holding portion 25 is separated from the lead fitting by the partition wall 26 nearly arrow-shaped in cross section. Still further, a taper face 26*a* is provided on the inward face of the partition wall 26 to allow a lead wire to bend. Hence, for example, when a lead wire 74 is secured at one end of a lead fitting 42 by the spring force of a clamp spring 47 as shown in FIG. 13, the end of the lead wire 74 is bent in a shape close to a dogleg. This configuration has an advantage in making the pulling out of the lead wire more difficult.

Figure 9:
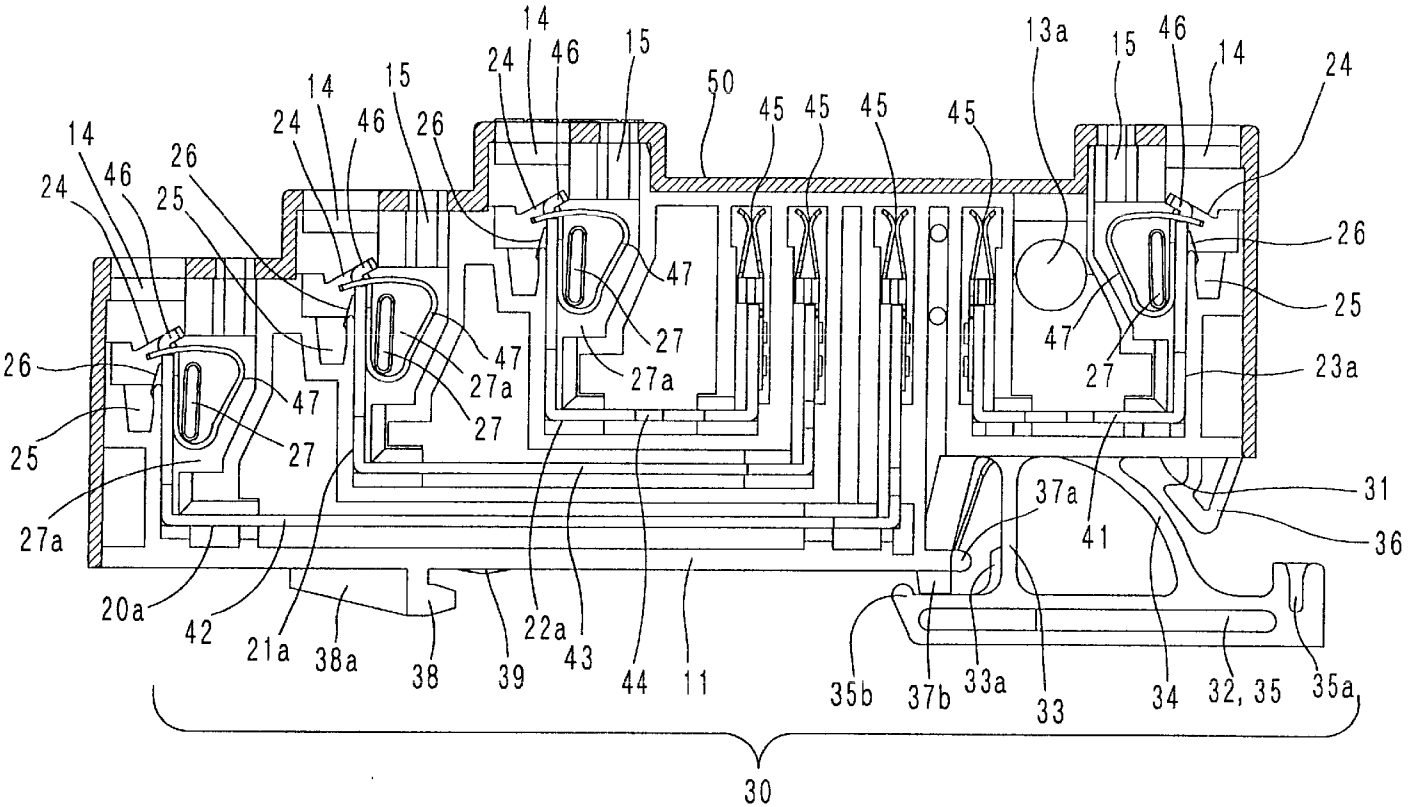
FIG. 9 is a front sectional view showing a state wherein the connection mechanism portions and the case are assembled with the base shown in FIG. 2.

The rail installation structure 30 has a stepped portion 31 formed on one side of the bottom face of the base 11 as shown in FIG. 9. A nearly T-shaped elastic hook 32 is projected on the ceiling face of the stepped portion 31. The elastic hook 32 is formed by horizontally connecting a movable hook portion 35 to the lower ends of a straight leg portion 33 and an arc-shaped leg portion 34 so as to be integrated therewith. At one end of the movable hook portion 35, a recessed portion 35*a* is formed so that a dismounting tool for dismounting the terminal 10 from a rail 70 can be positioned therein. Furthermore, at the other end of the movable hook portion 35, an engagement projection portion 35*b* is formed. Still further, a reinforcing rib 33*a* is integrally formed inside the base portion of the straight leg portion 33.

Additionally, a breakage prevention stopper 36 capable of making contact with the arc-shaped leg portion 34 and restricting the position thereof at the time when the terminal is mounted on and dismounted from the rail 70 is formed near the outside fringe of the stepped portion 31. Furthermore, near the inside fringe of the stepped portion 31, a breakage prevention stopper 37*a* extending sideways and a guide projection portion 37*b* extending downward are formed. The stopper 37*a* has outer dimensions capable of making contact with the reinforcing rib 33*a* of the straight leg portion 33 and restricting the position thereof. Still further, together with the engagement projection portion 35*b* of the elastic hook 32, the guide projection portion 37*b* engages the fringe of the rail 70 (see FIGS. 16 and 17).

In addition, on the other side of the bottom face of the base 11, an engagement hook 38 is projected in parallel with the guide projection portion 37*b* so as to have a predetermined clearance therefrom. This engagement hook 38 has a reinforcing rib 38*a*. Near the engagement hook 38, a press-contact projection portion 39 for preventing a gap from occurring when the terminal is mounted on the rail 70 is provided.

As shown in FIG. 2, the connection mechanism portion 40 comprises a first lead fitting 41 for connection to a coil terminal of a relay and a lead wire, a second lead fitting 42 for connection to the common contact terminal of the relay and a lead wire, and third and fourth lead fittings 43 and 44 for connection to the fixed contact terminals of the relay and lead wires. The first lead fitting 41 and the fourth lead fitting 44 have the same shape.

Figure 6A:
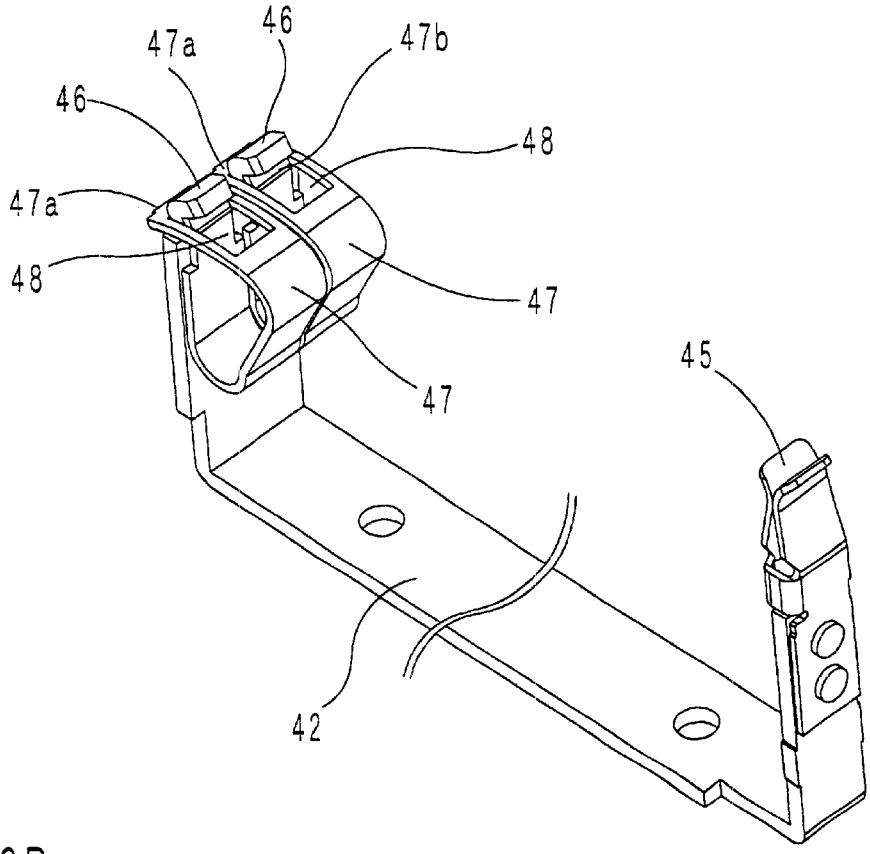
FIG. 6A is an enlarged perspective view showing a lead fitting constituting the connection mechanism portions shown in FIG. 2.
Figure 6B:
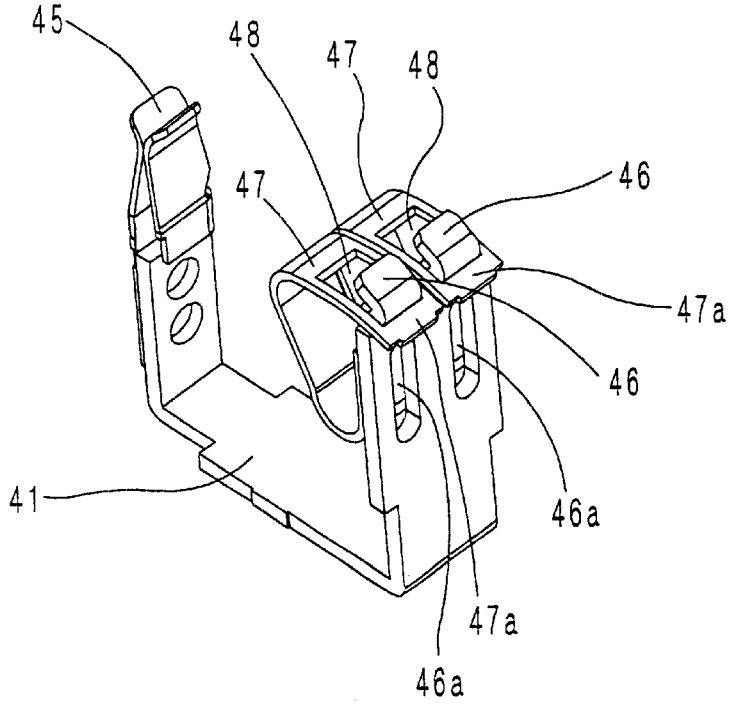
FIG. 6B is an enlarged perspective view showing another lead fitting constituting the connection mechanism portions shown in FIG. 2.

As shown in FIGS. 6A and 6B, a socket portion 45 is secured by crimping to the upper end of the rising portion on one side of each of the nearly U-shaped lead fittings 41 and 42. Furthermore, the upper end of the rising portion on the other side of each of the lead fittings 41 and 42 is divided into two parts in the direction of its width and bent in a shape close to a dogleg, thereby forming bent portions 46 and 46. A clamp spring 47 is mounted on each of the bent portions 46.

A hold hole 46*a*, in which the lead fitting is supported when the clamp spring 47 is mounted, is formed nearly under the bent portion 46. Furthermore, the lead fitting 43 has a shape similar to those of the lead fittings 41 and 42.

The clamp spring 47 is formed of a strip-shaped elastic leaf spring and has a circularly bent shape, and a connection hole 48 is formed near one end 47*a* of the clamp spring 47. The other end 47*b* of the clamp spring 47 is engaged with the inside of the bent portion 46 of the lead fitting. Furthermore, the bent portion 46 is fitted into the connection hole 48 so as to project therefrom. The inside fringe of the connection hole 48 is engaged with the outside of the bent portion 46. In particular, the inside fringe of the connection hole 48 in the clamp spring 47 makes pressure contact with the outside face of the bent portion 46 by the spring force thereof.

As shown in FIG. 4, the lead fittings 41, 42, 43 and 44 are press-fitted sideways into the press-fit grooves 20*a*, 20*b*, 21*a*, 21*b*, 22*a*, 22*b*, 23*a* and 23*b* in the base 11, respectively. Hence, the clamp spring 47 is fitted with the stopper 27 of the base 11 and accommodated in the clamp spring accommodation portion 27*a*. In addition, the bent portions 46 make pressure contact with the taper face 24 of the base 11 (see FIG. 9). Furthermore, the hold holes 46*a* in the lead fitting are blocked by the partition wall 26. For this reason, lead wire chips do not drop to the adjacent space, that is, the clamp spring accommodation portion 27*a*, through the hold holes 46*a*.

The case 50 is a molded component having an outside shape capable of being fitted with the base 11 as shown in FIG. 2. A recessed portion 51 on which a relay can be mounted is formed in the case 50. One side of the case 50 has a staircase-like shape. Furthermore, a slit 52 into which the lever 60, described later, can be inserted is formed at the central portion of the recessed portion 51. Terminal holes 53 are formed at predetermined intervals on both sides of the slit 52. Still further, lead wire insertion holes 54 and operation rod insertion holes 55 are disposed as necessary at predetermined intervals on the upper faces on both sides of the recessed portion 51.

Figure 7:
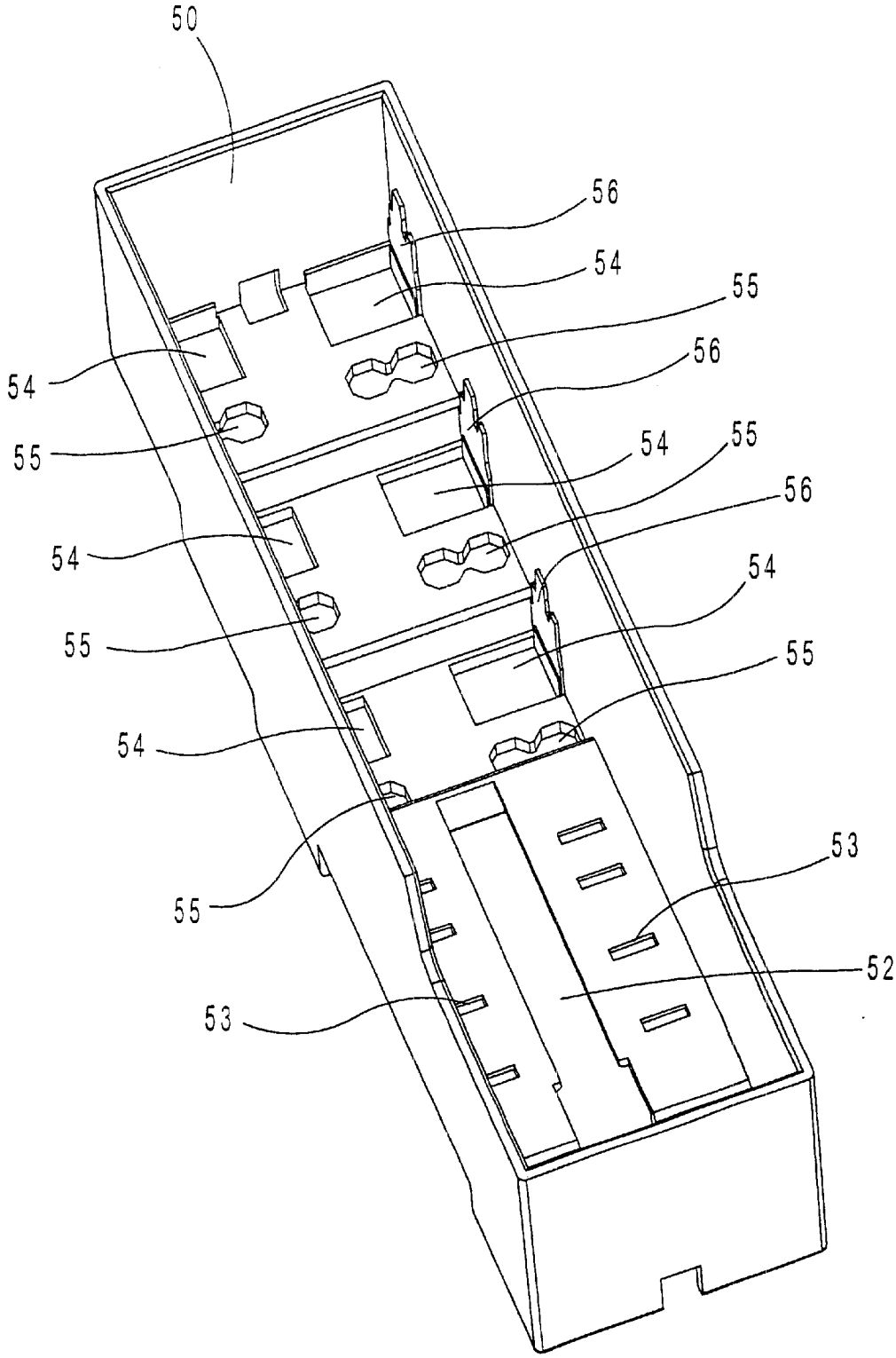
FIG. 7 is an enlarged perspective view showing a case shown in FIG. 2 from its lower side.
Figure 8A:
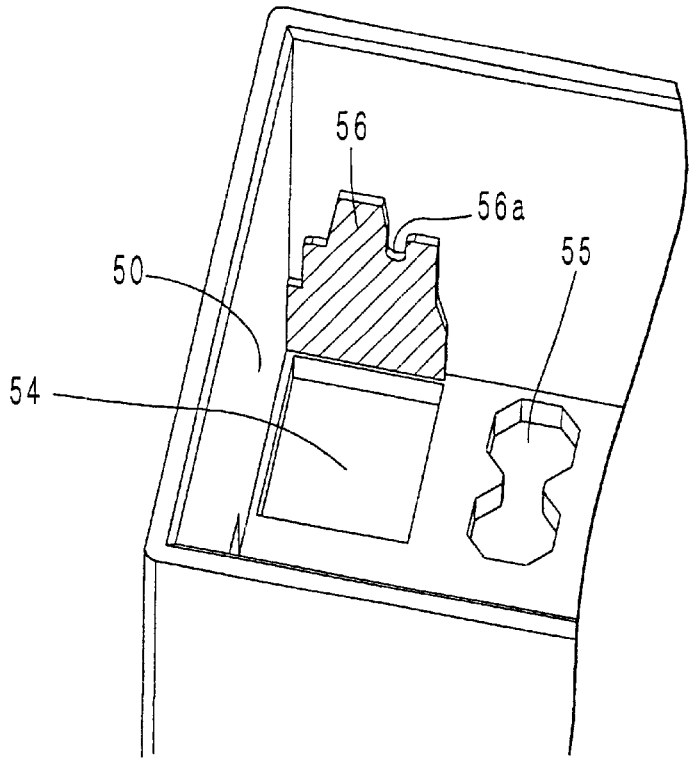
FIG. 8A is an enlarged perspective view showing the case at a different angle.
Figure 8B:
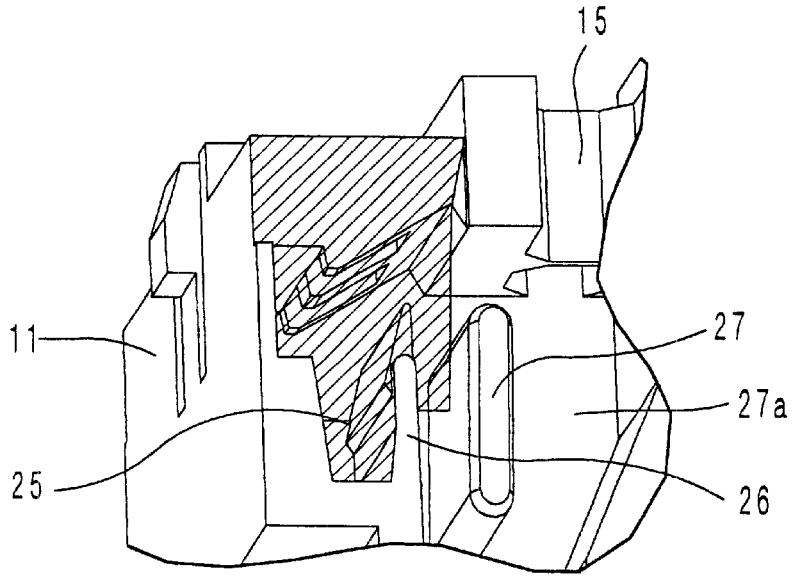
FIG. 8B is a partially perspective view illustrating how to use the case.

In addition, as shown in FIGS. 7 and 8, projection portions 56 are formed at predetermined intervals on the inside faces of the case 50. The projection portion 56 has a shape capable of being fitted into the side opening of the nearly U-shaped lead wire holding portion 25 of the base 11.

Hence, when the case 50 is fitted with the base 11, the lead wire insertion holes 54 and the insertion holes 55 in the case 50 are coaxially aligned and communicated with the lead wire insertion holes 14 and the operation rod insertion holes 15 in the base 11, respectively. Furthermore, the projection portions 56 on the case 50 are fitted into the side openings of the nearly U-shaped lead wire holding portions 25 of the base 11 to block the side openings. Therefore, no gap occurs between the outside face of the base 11 and the inside face of the case 50. As a result, lead wire chips built up in the lead wire holding portions 25 do not drop from the lead wire holding portions 25 along the inside face of the case 50, thereby preventing improper insulation. Furthermore, the recessed portion 56*a* in the projection portion 56 is fitted with the upper end of the partition wall 26, thereby being advantageous in reinforcing the assembly of the base 11 and the case 50.

Figure 14:
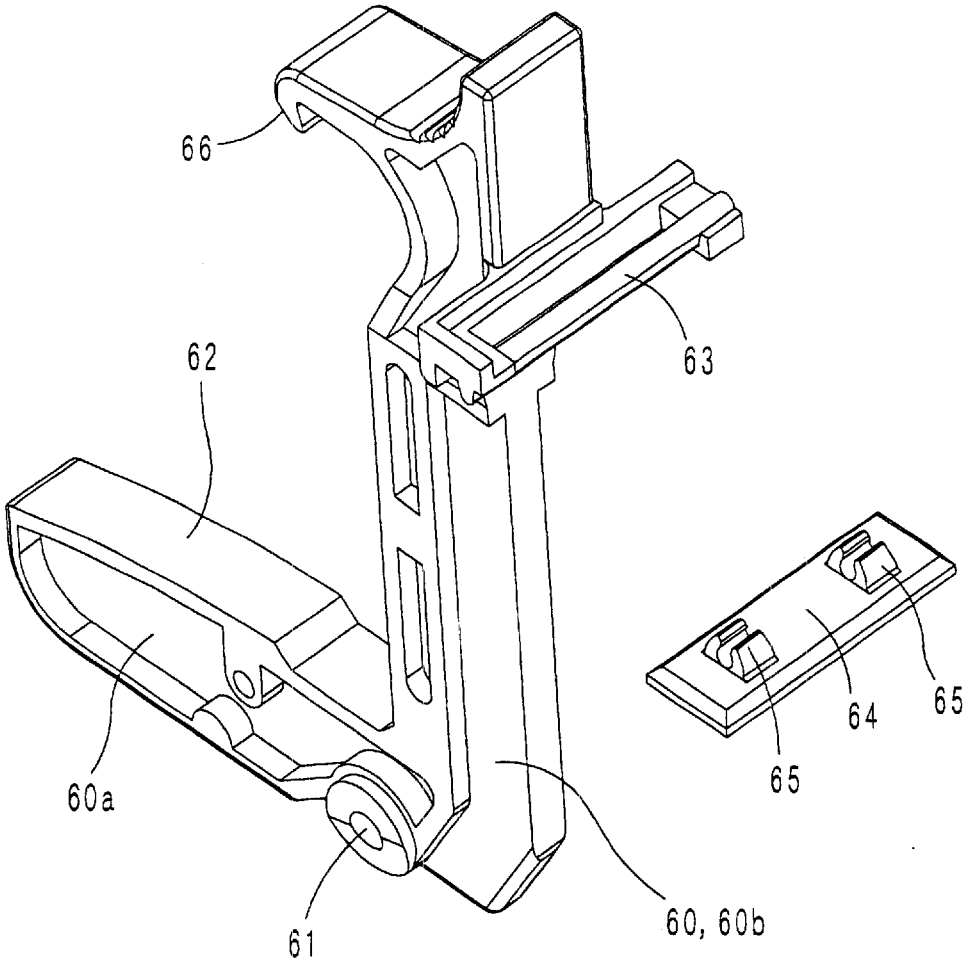
FIG. 14 is a magnified exploded perspective view showing the lever shown in FIG. 2.

The relay mounting/dismounting lever 60 is a molded component and is nearly L-shaped when viewed from the front as shown in FIG. 14. Rotation shafts 61 being coaxial to each other are projected on both side faces of the corner portion of the lever 60. In addition, an arc-shaped face 62 for smoothly raising a relay, described later, is formed on the horizontal portion 60*a* of the lever 60. On the other hand, an installation shaft 63 is integrally molded on the outside face of the vertical portion 60*b* of the lever 60. Furthermore, an engagement hook 66 extends from the upper end of the vertical portion 60*b*. Additionally, a nameplate 64 is removably installed on the installation shaft 63. Two sets of elastic hooks 65 and 65 projected on the rear face of the nameplate 64 elastically hold the installation shaft 63.

In this embodiment, the nameplate 64 is disposed on the right face of the vertical portion 60*b* of the lever 60, whereby the nameplate 64 can be noticed easily by operators and can be used conveniently.

The nameplate 64 may be disposed on the front face or the rear face of the vertical portion 60*b* of the lever 60. Its installation position can be changed by selection as necessary.

Through the slit 52 in the case 50, the rotation shafts 61 of the lever 60 are fitted into the shaft holes 13*a* formed on both sides of the insertion groove 13 of the base 11. Hence, the lever 60 is rotatably supported by the base 11. In particular, the lever 60 can rotate forward as well as backward as shown in FIG. 15. For this reason, even when lead wires are connected at the rear side of the lever 60, the connection work can be carried out easily without being obstructed by the lever 60. This configuration is thus advantageous.

Figure 16:
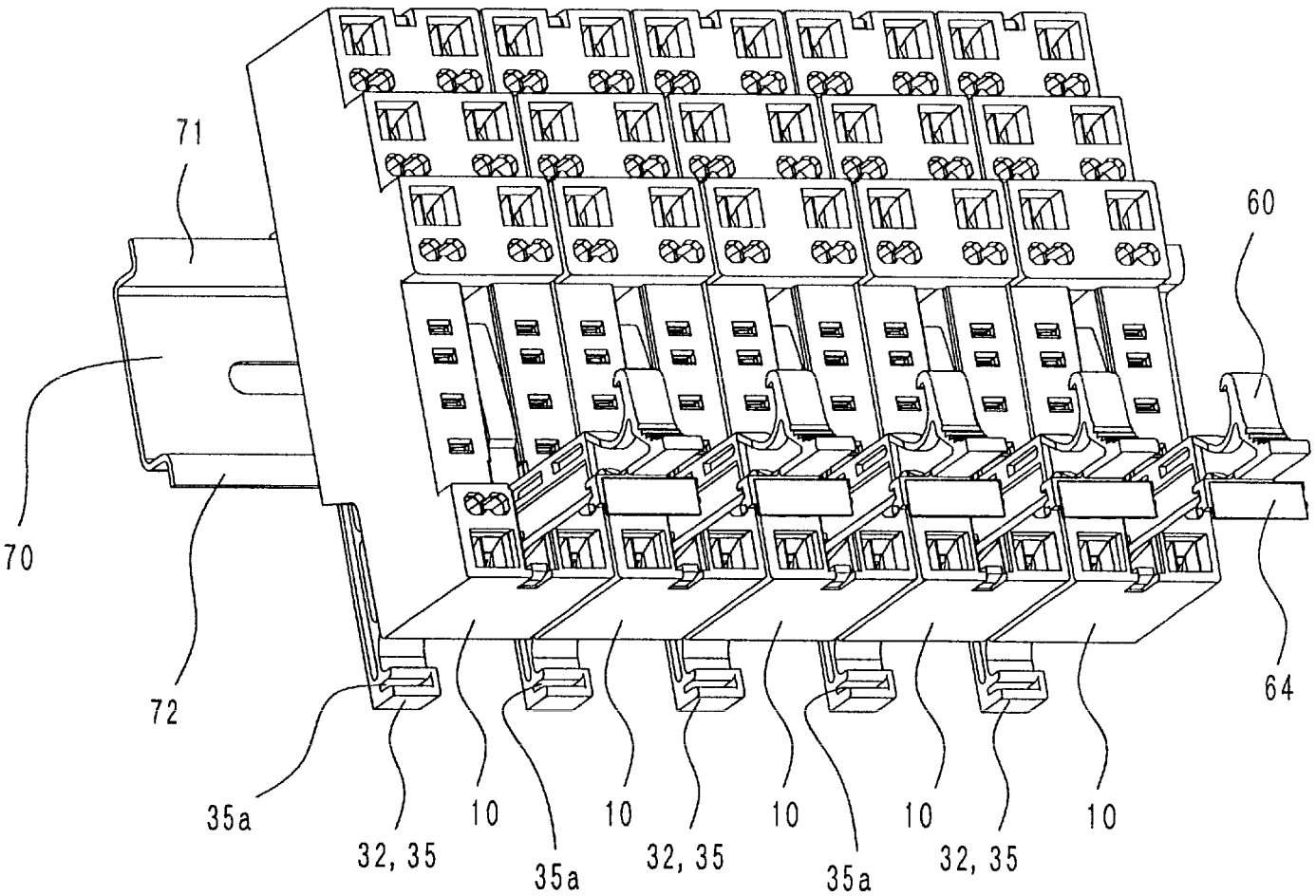
FIG. 16 is a perspective view illustrating the usage state of the electrical device connection terminals shown in FIG. 1.

Next, a case wherein the electrical device connection terminal 10 in accordance with this embodiment is removably mounted and used on the rail 70 having the cross sectional shape of an inverted hat as shown in FIG. 16 will be described below.

First, the engagement hook 38 of the base 11 is engaged with one side fringe 71 of the rail 70 so as to be positioned. When the terminal 10 is wholly pressed against the rail 70, the straight leg portion 33 and the arc-shaped leg portion 34 are elastically deformed outward and then return to their original positions. Hence, the guide projection portion 37*b* makes contact with the other side fringe 72 of the rail 70, and the engagement projection portion 35*b* of the elastic hook 32 is engaged with the other side fringe 72, whereby the installation work is completed.

Figure 17:
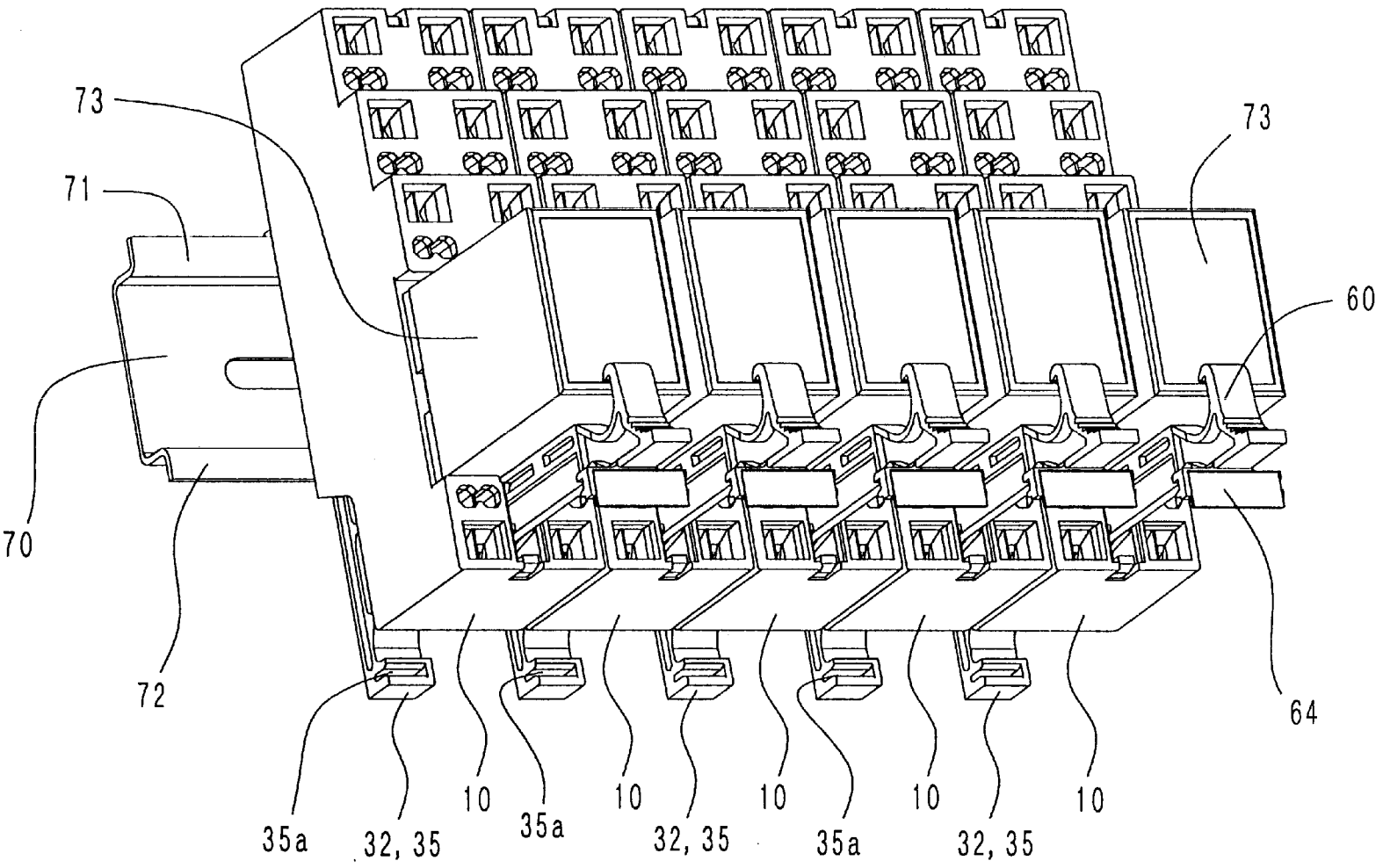
FIG. 17 is a perspective view showing a state wherein relays are mounted on the electrical device connection terminals shown in FIG. 16.
Figure 18:
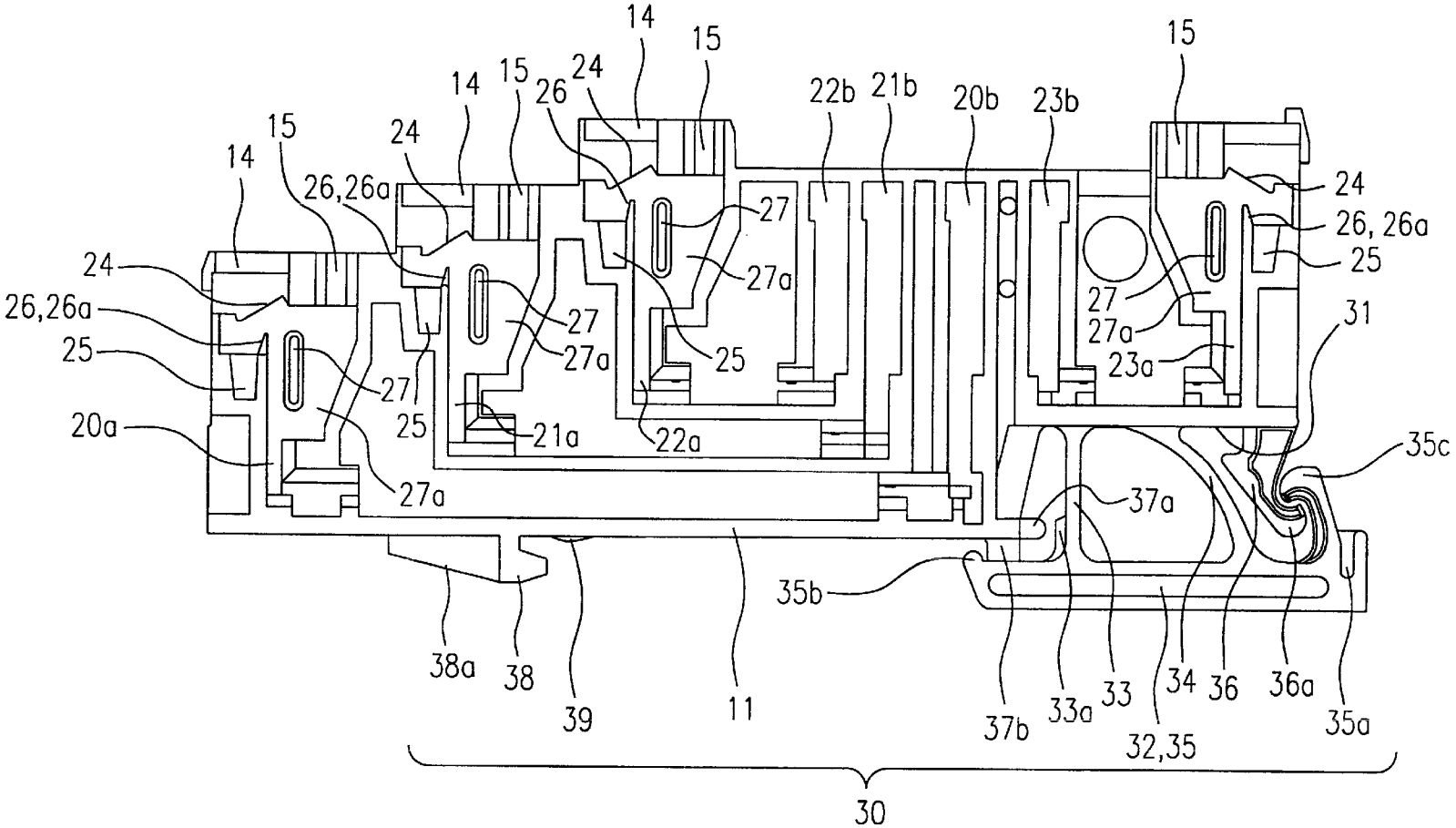
FIG. 18 is a front view showing a base in accordance with a second embodiment of the present invention.
Figure 19A:
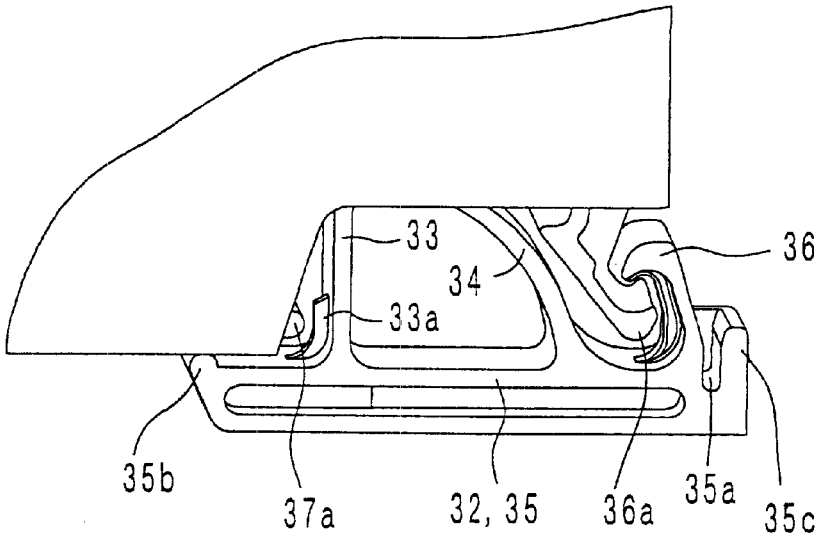
FIG. 19A and FIG. 19B are partially enlarged perspective views showing the base shown in FIG. 18 at different angles.
Figure 19B:
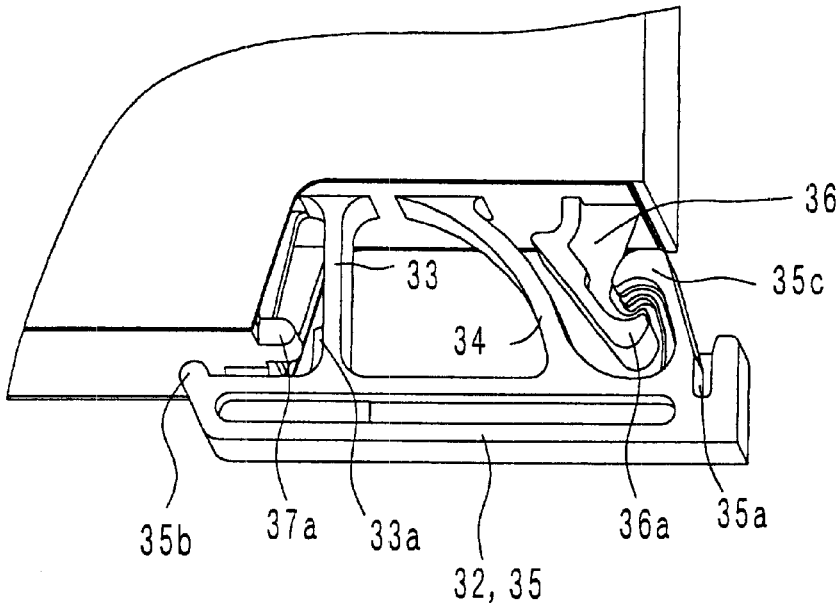

Then, relays 73 are mounted on the terminals 10 as shown in FIG. 17, whereby external circuits can be switched.

When dismounting the terminal 10 from the rail 70, place the tip of a flat-blade screwdriver or the like in the recessed portion 35*a* of the elastic hook 32, and operate the screwdriver so as to pull out the terminal. By this operation, the straight leg portion 33 and the arc-shaped leg portion 34 are elastically deformed, and the engagement projection portion 35*b* is disengaged from the other side fringe 72 of the rail 70. As a result, the terminal 10 can be dismounted from the one side fringe 71 of the rail 70.

Therefore, in accordance with this embodiment, the terminal 10 can be mounted at a desired position on the rail 70 by one-touch simple operation and can be dismounted easily. In addition, the elastic hook 32 and the like are integrated with the base 11. It is thus advantageous in reducing the number of components and in simplifying production processes.

On the other hand, when connecting a lead wire, insert an operation rod into the insertion hole 55 of the case 50 to elastically deform the clamp spring 47, and then insert lead wire 74 into the connection hole 48 in the clamp spring 47. By pulling out the operation rod, the clamp spring 47 is allowed to return elastically to its original position, whereby the lead wire 74 is held between the lead fitting and the clamp spring 47. Hence, electrical connection is established. A plurality of the lead wires 74 can be connected easily by repeating the same connection work. Furthermore, by positioning and mounting the relay 73 on the recessed portion 51 of the case 50, the terminals of the relay 73 are press-fitted into the socket portions 45 of the lead fittings, thereby establishing electrical connection.

Figure 15A:
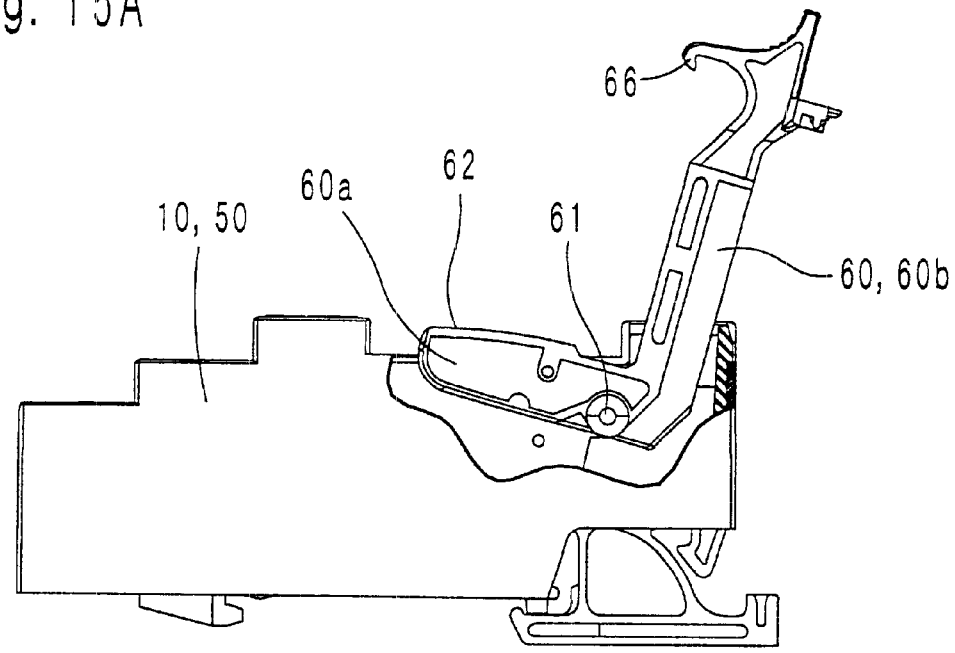
FIG. 15A and FIG. 15B are partially cutaway front views illustrating the operation of the lever mounted on the base.
Figure 15B:
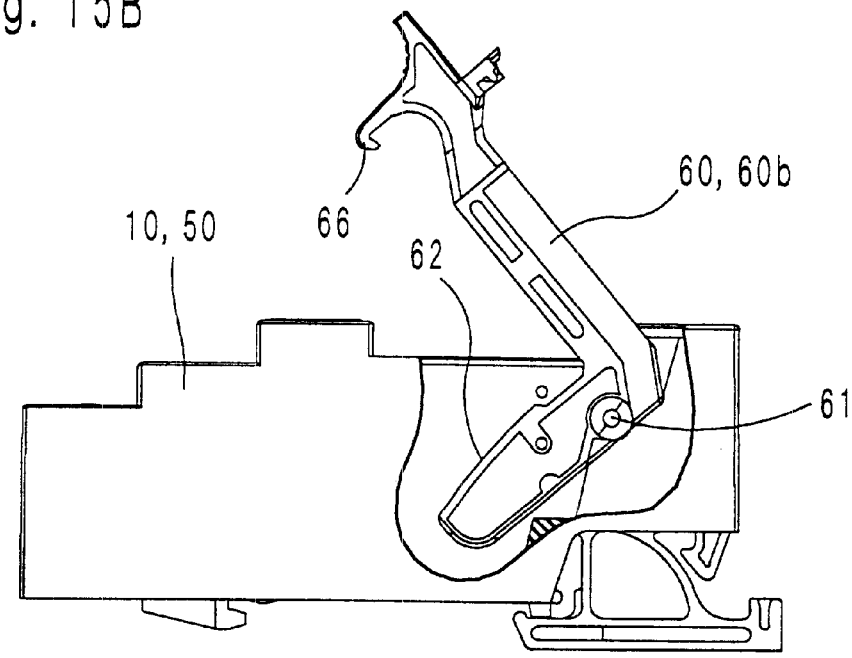

When dismounting the relay 73 from the terminal 10, turn the relay mounting/dismounting lever 60 as shown in FIG. 15A. As a result, the bottom face of the relay 73 is pushed upward and lifted by the arc-shaped face 62 of the horizontal portion 60*a*. Then simply remove the relay 73.

Furthermore, when removing the lead wire 74, insert the insertion rod into the insertion hole 55 to elastically deform the clamp spring 47 and to release the clamp force applied to the lead wire 74. Then, pull out the lead wire 74 from the connection hole 48 in the clamp spring 47, and remove the operation rod. In this way, the dismounting work is completed.

Figure 11B:
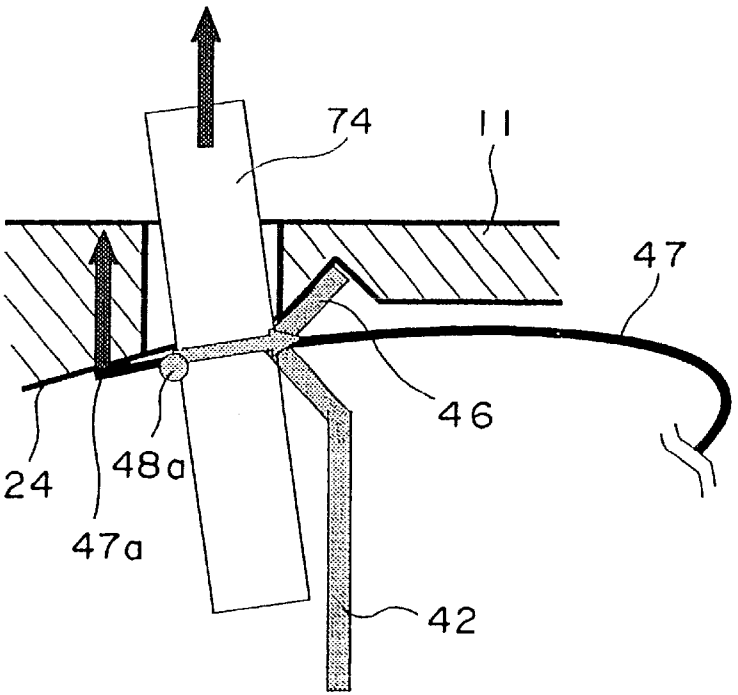
FIG. 11B is a partially sectional view showing a state after the operation of the clamp spring.
Figure 11A:
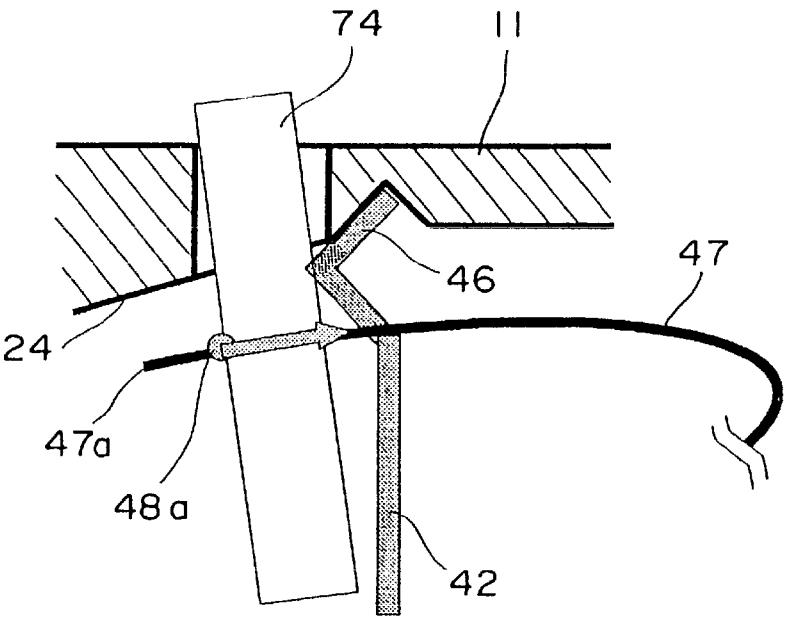
FIG. 11A is a partially sectional view showing a state before the operation of a clamp spring.
Figure 12:
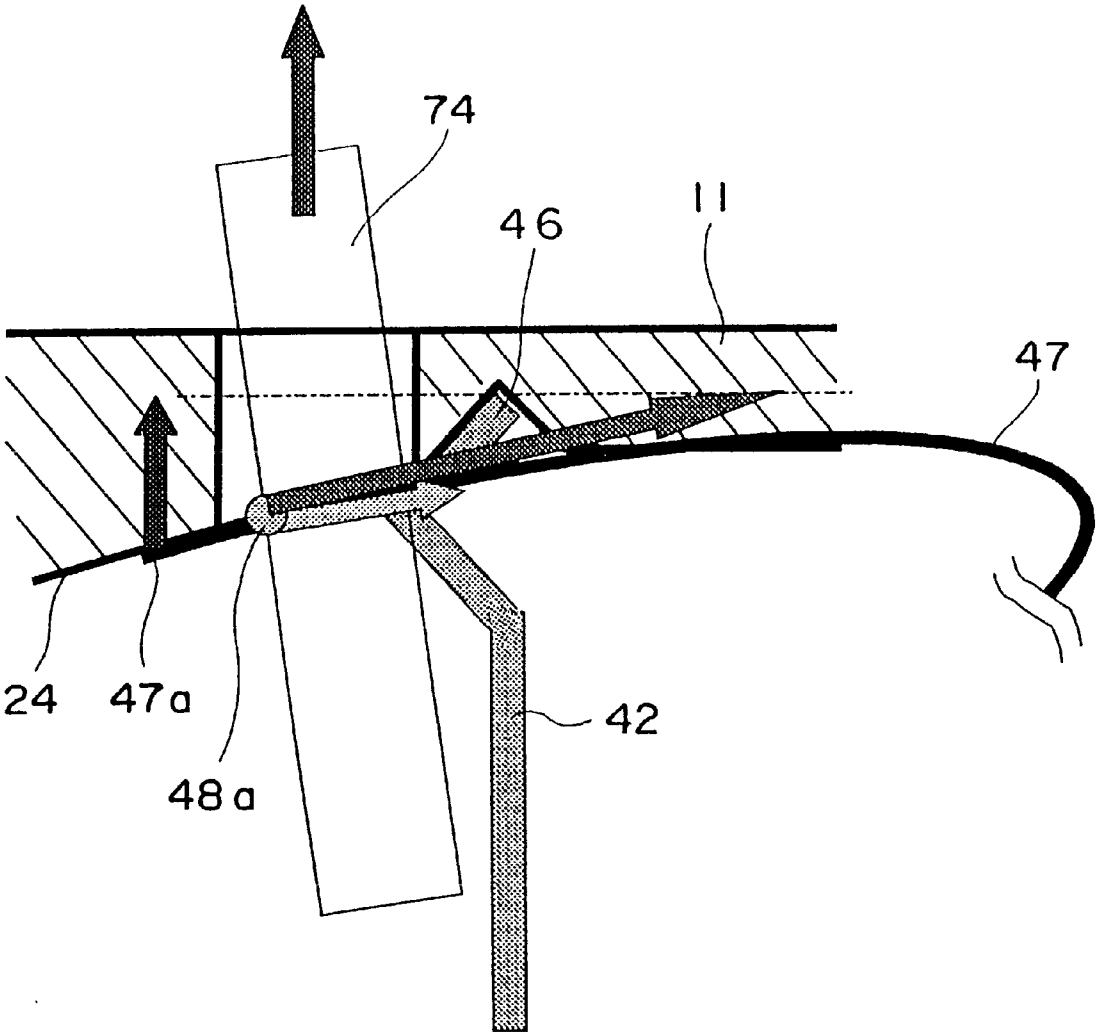
FIG. 12 is a partially sectional view showing the state shown in FIG. 11B in greater detail.

If an excessive pulling force is applied to the lead wire 74 connected to the lead fitting 42 as shown in FIGS. 11 and 12, the free end 47*a* of the clamp spring 47 is pulled upward. Hence, the free end 47*a* makes line and pressure contact with the taper face 24 of the base 11, whereby a part of the force applied to pull out the lead wire 74 is exerted as a component for pushing back the clamp spring 47. As a result, the action point 48*a* at the inside fringe of the connection hole 48 in the clamp spring 47 pushes the lead wire 74 against the lead fitting 42. Hence, the larger the pulling force, the larger the component for pushing back the clamp spring 47. The lead wire 74 is thus firmly pushed against the lead fitting 42, whereby this configuration is advantageous in preventing the lead wire 74 from being pulling out.

In particular, in this embodiment, the partition wall 26 having the taper face 26*a* is disposed between one end of the lead fitting 42 and the lower end of the lead wire 74 as shown in FIG. 13. Hence, the lower end of the lead wire 74 is bent in a shape close to a dogleg by the bent portion 46 of the lead fitting 42 and the taper face 26*a* of the partition wall 26, whereby this configuration is advantageous in further preventing the lead wire 74 from being pulling out.

A second embodiment of the present invention has a rail installation structure different from that of the first embodiment.

More specifically, the second embodiment differs in that a projection 36*a* projecting sideways is formed on the stopper 36 and that a contact hook portion 35*c* capable of making contact with the projection 36*a* is formed at one end of the movable hook portion 35.

In this embodiment, when the terminal 10 is dropped by mistake, the contact hook portion 35*c* of the movable hook portion 35 first makes contact with the projection 36*a* of the stopper 36. Then, the reinforcing rib 33*a* of the straight leg portion 33 makes contact with the stopper 37*a*. For this reason, in this embodiment, the impact force at the time of drop is absorbed and released in two steps, and a high degree of stress concentration is hard to occur at the legs 33 and 34, whereby this configuration is advantageous in making the legs harder to break.

Figure 20A:
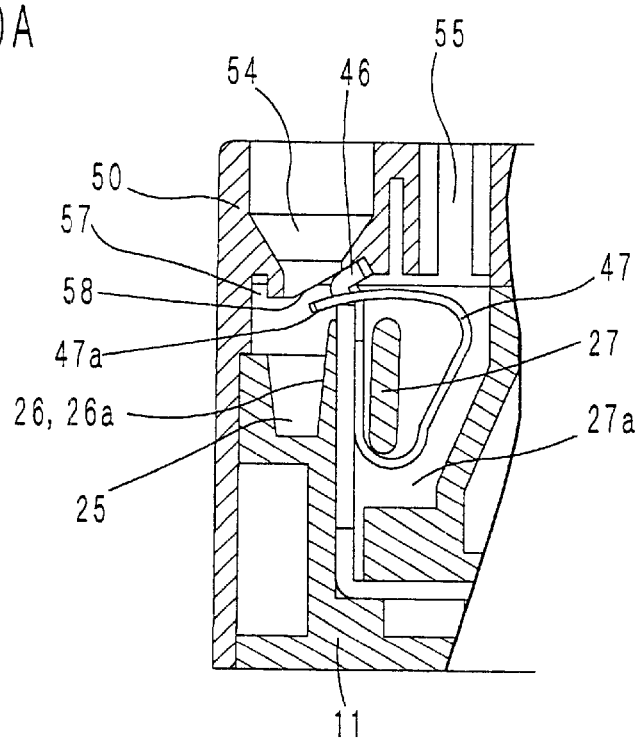
FIG. 20A is a partially enlarged sectional view showing a part of an electrical device connection terminal in accordance with a third embodiment of the present invention.
Figure 20B:
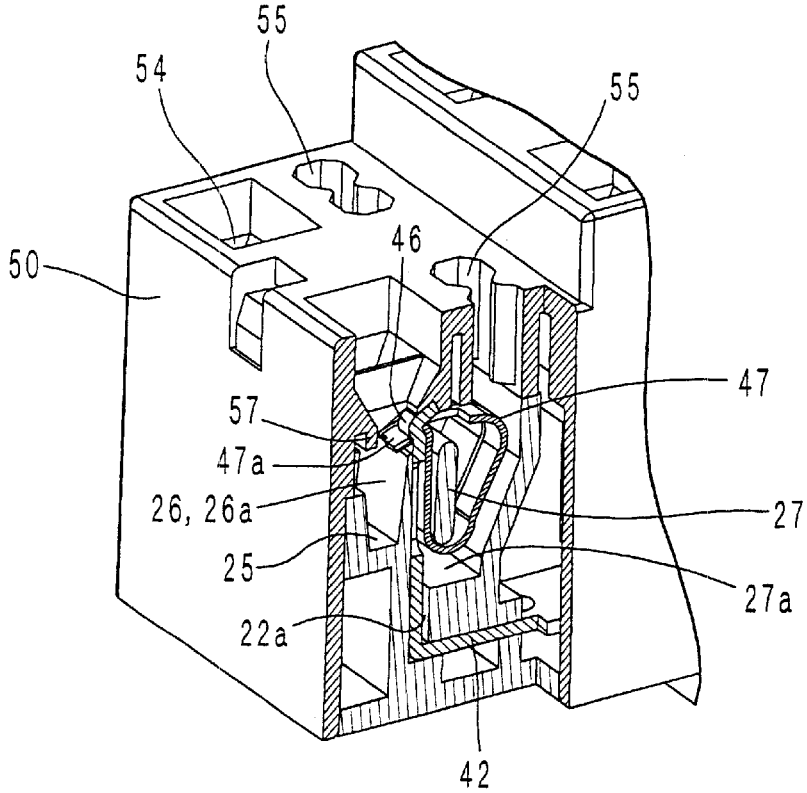
FIG. 20B is a partially sectional perspective view showing the third embodiment.
Figure 22:
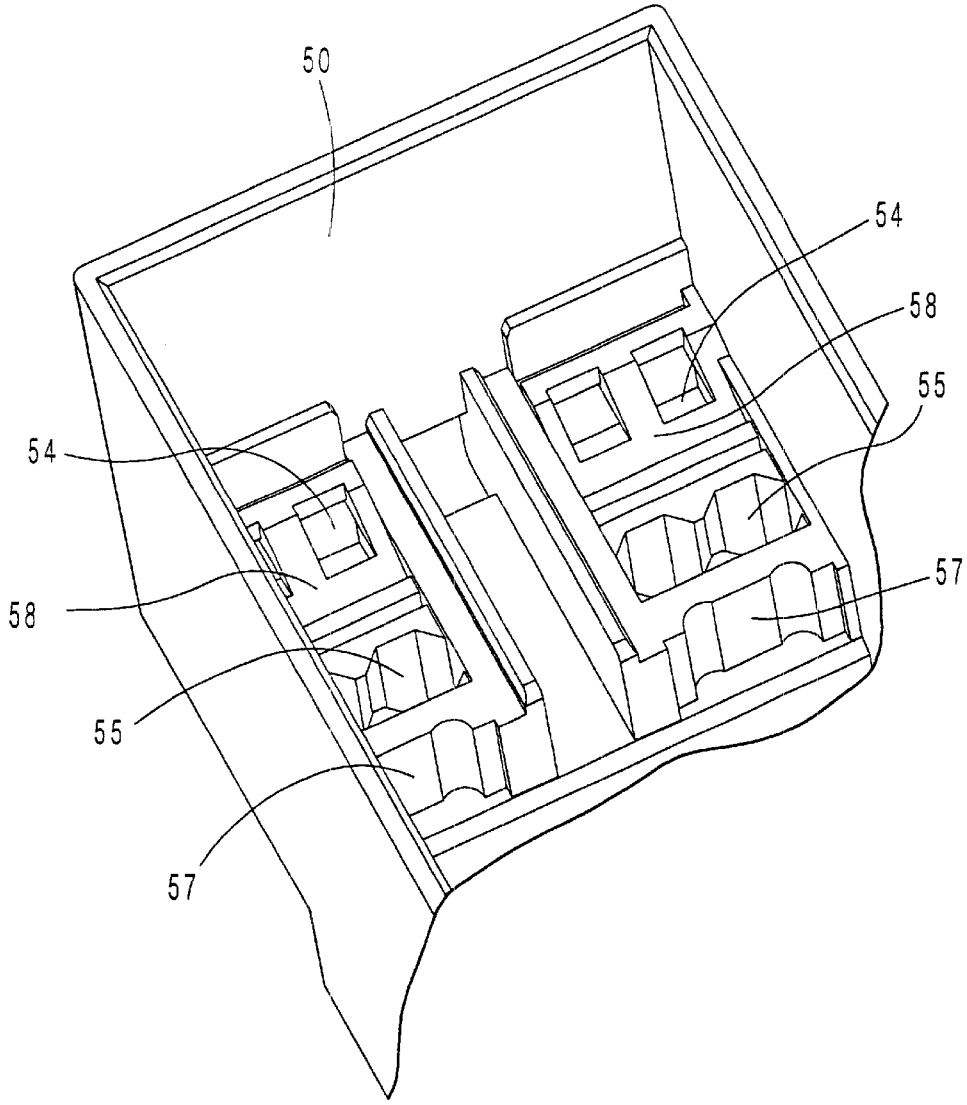
FIG. 22 is a partially enlarged perspective view showing the case shown in FIG. 20.

In the above-mentioned first embodiment, the lead wire insertion holes 14 and the operation rod insertion holes 15 are formed in the base 11. In a third embodiment of the present invention, however, all those holes are formed in the case 50 as shown in FIGS. 20 and 22. In other words, the upper face of the case 50 is formed in a staircase-like shape, and thick stepped portions 57 are formed below the upper face. The lead wire insertion hole 54 and the insertion hole 55 for the operation rod are formed for each of the stepped portions 57.

Figure 21:
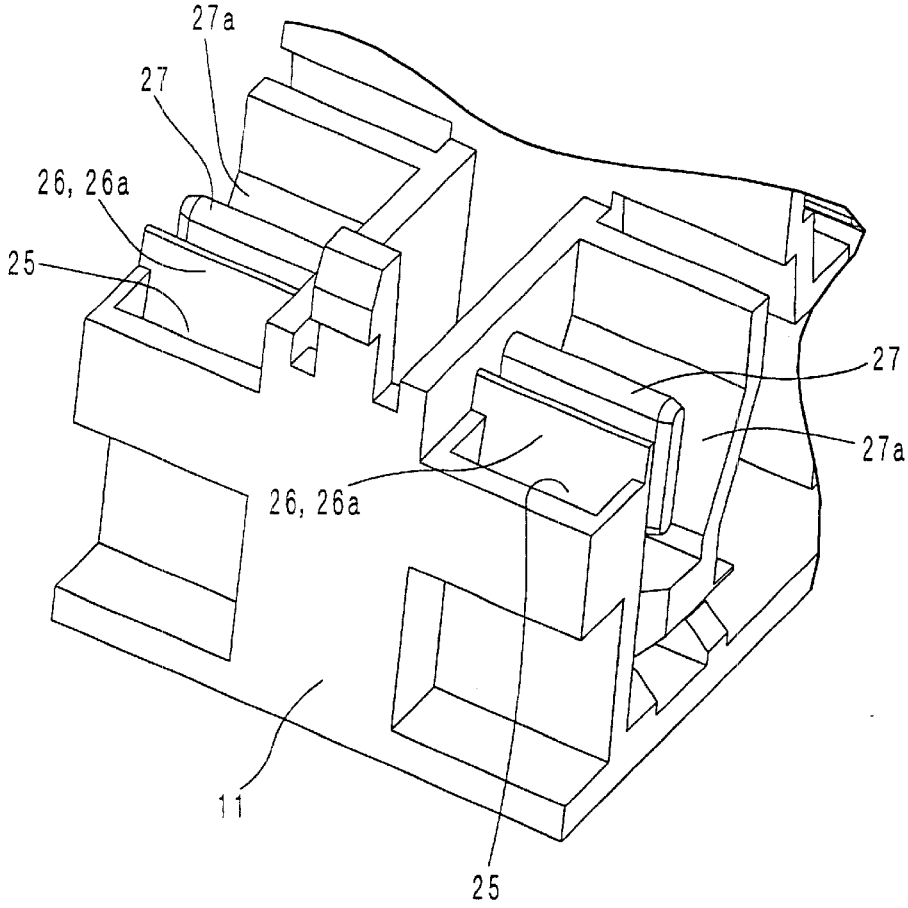
FIG. 21 is a partially enlarged perspective view showing the base shown in FIG. 20.

Furthermore, in this embodiment, the lead wire holding portion 25 capable of accommodating lead wire chips is enclosed by partition walls in four directions (see FIG. 21). Hence, a projection for blocking the side opening of the lead wire holding portion 25 is not required to be formed on the inside face of the case 50. Still further, a taper face 58 with which one end 47*a* of the clamp spring 47 makes contact is formed directly below the insertion hole 54.

On the other hand, just as in the case of the first embodiment, the taper face 26*a* is formed on the partition wall 26, that is, one of the inside faces of the lead wire holding portion 25, to prevent the lead wire 74 from coming off. Since the third embodiment is similar to the first embodiment in other respects, the explanation of the third embodiment is omitted.

Figure 23:
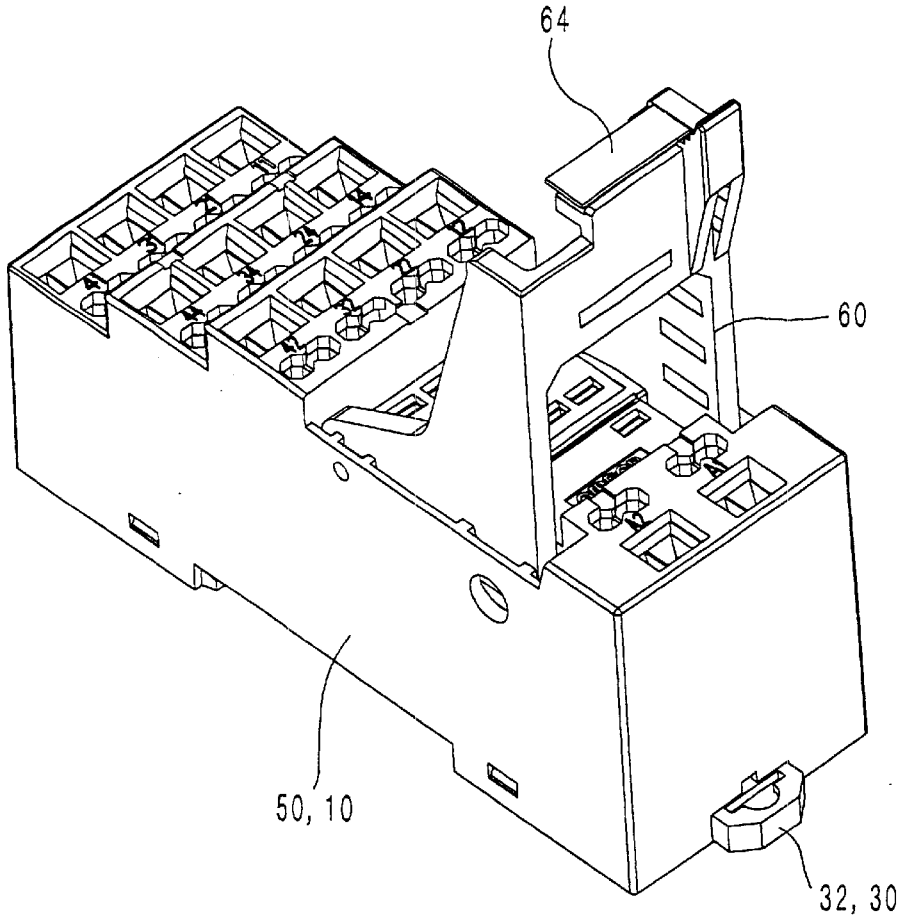
FIG. 23 is a perspective view showing an electrical device connection terminal in accordance with a fourth embodiment of the present invention.
Figure 24:
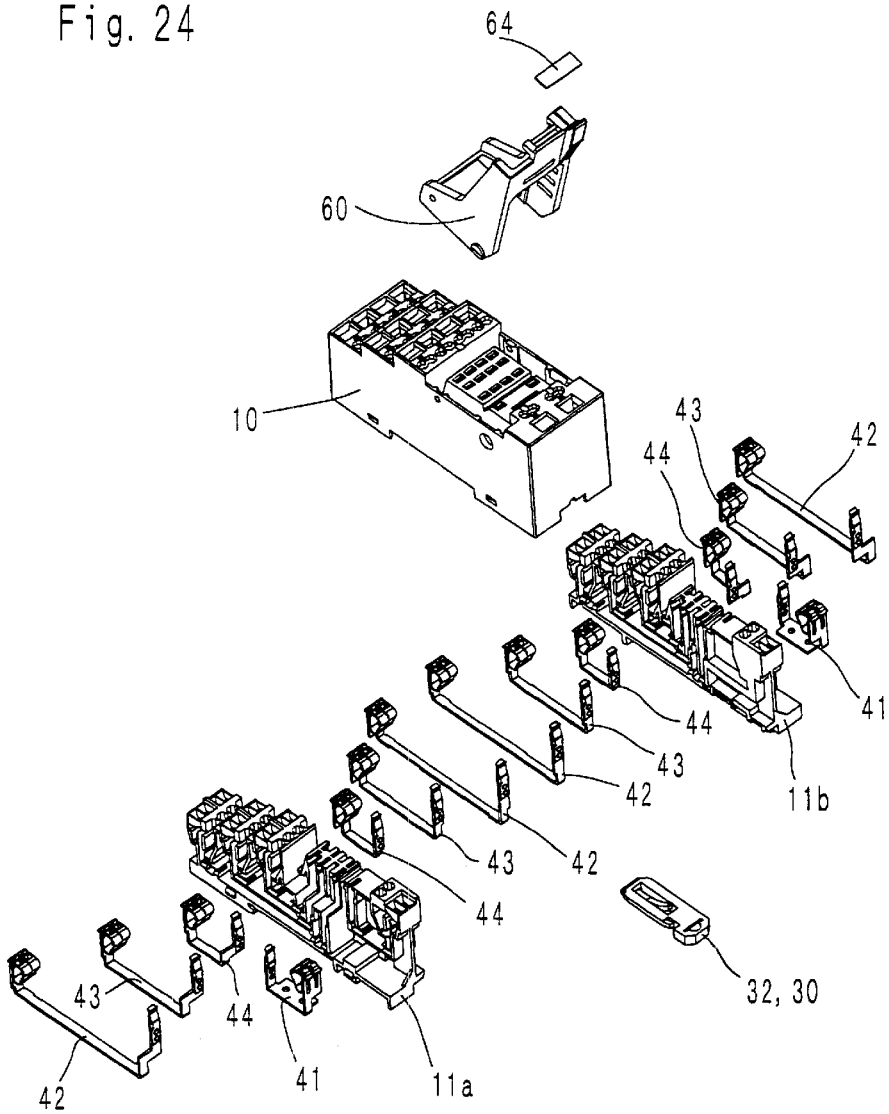
FIG. 24 is an exploded perspective view showing the electrical device connection terminal shown in FIG. 23.

An electrical device connection terminal in accordance with a fourth embodiment of the present invention is a four-pole electrical device connection terminal comprising one set of dividable bases 11*a* and 11*b* as shown in FIGS. 23 and 24. The lead wire insertion and support structures of the fourth embodiment are almost similar to those of the first embodiment.

However, in this embodiment, the rail installation structure 30 is integrated with the elastic hook 32 that is separated from the base 11. In this respect, this embodiment differs from the first embodiment. However, in other respects, this embodiment is fairly similar to the above-mentioned first embodiment. Hence, the same components are designated by the same numerals, and their explanations are omitted.

EXAMPLE

Figure 10A:
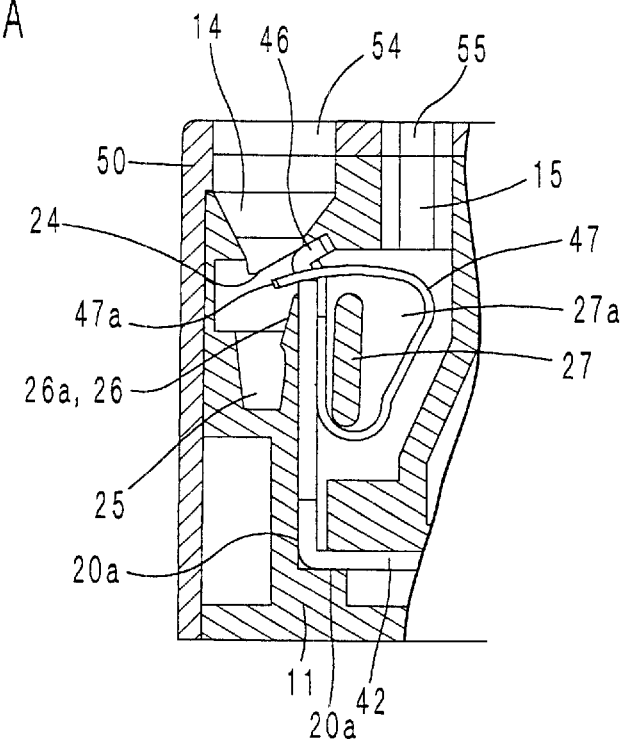
FIG. 10A is a sectional view of FIG. 9.
Figure 10B:
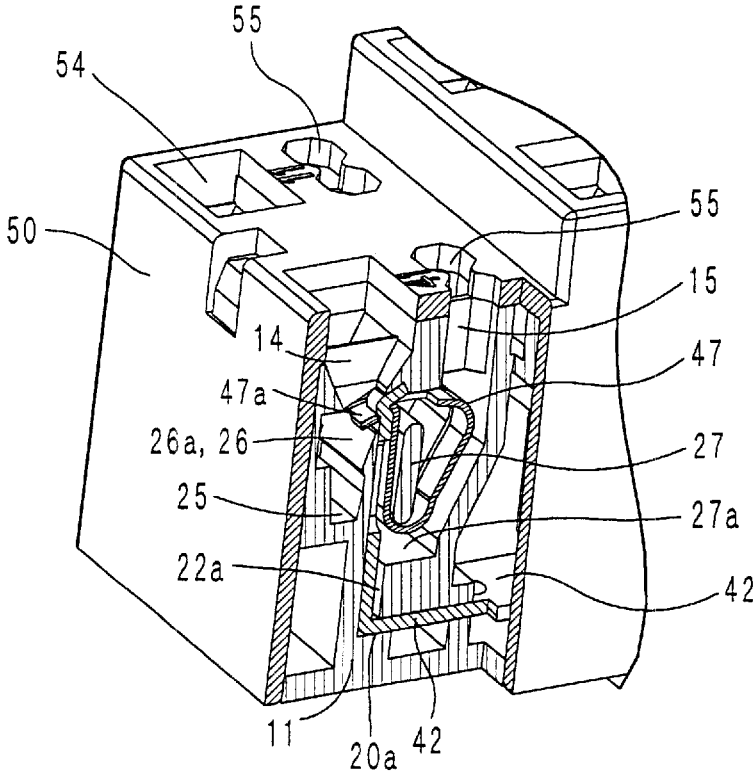
FIG. 10B is a partially sectional view of FIG. 9.
Figure 25:
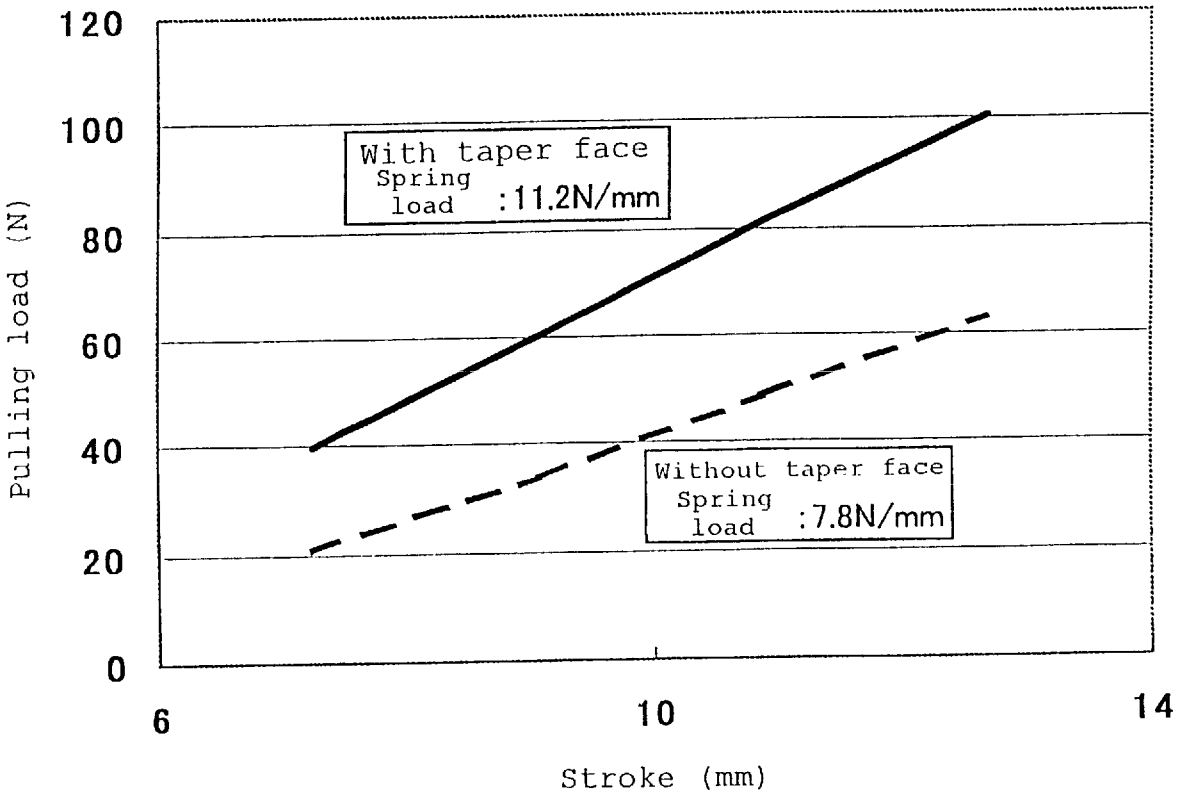
FIG. 25 is a graph showing the result of measurement conducted on changes in lead wire pulling load.

An example was produced such that the taper face 26*a* was formed by providing the partition wall 26 having the shape of an arrow in accordance with the first embodiment as shown in FIG. 10. Another example not provided with the taper face was produced as a comparison example. Lead wire pulling loads in the cases of these examples were measured, and the result of the measurement is shown in FIG. 25.

As clearly indicated by the result of the measurement, it is found that the lead wire pulling load in the case of the example of the first embodiment is larger than that in the case of the comparison example even at the beginning of pulling. It is thus found that it is harder to pull out the lead wire in the case of the example of the first embodiment.

What is claimed is:

1. An electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with said clamp spring accommodation portions and said lead wire holding portions are provided on the side face of said base; nearly L-shaped lead fittings provided with a clamp spring on one side of the upper end of each lead fitting are press-fitted into said L-shaped grooves sideways; by inserting lead wires inserted through said lead wire insertion holes into the connection holes in said clamp springs while operating said clamp springs with an operation rod inserted into each of said operation rod insertion holes, each of said lead wires is held between said lead fitting and said clamp spring by the spring force of said clamp spring to establish electrical connection, said electrical device connection terminal is characterized in that a side wall for separating said lead wire holding portion from said lead fitting is projected on the bottom face fringe of said lead wire holding portion so as to be adjacent to one side of said lead fitting.

2. An electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with said clamp spring accommodation portions and said lead wire holding portions are provided on the side face of said base; nearly L-shaped lead fittings provided with a clamp spring on one side of the upper end of each lead fitting are press-fitted into said L-shaped grooves sideways; by inserting lead wires inserted through said lead wire insertion holes into the connection holes in said clamp springs while operating said clamp springs with an operation rod inserted into each of said operation rod insertion holes, each of said lead wires is held between said lead fitting and said clamp spring by the spring force of said clamp spring to establish electrical connection, said electrical device connection terminal is characterized in that projection portions are disposed on the inside faces of a case to be fitted with said base so as to be fitted into and block the side openings of said lead wire holding portions formed in said base.

3. An electrical device connection terminal in accordance with claim 1, wherein projection portions are formed on the inside faces of said case to be fitted with said base so as to be fitted into and block the side openings of said lead wire holding portions formed in said base, and said projection portions are fitted into the upper ends of the side walls of said lead wire holding portions so as to support said side walls.

4. An electrical device connection terminal wherein clamp spring accommodation portions and lead wire holding portions are formed directly below operation rod insertion holes and lead wire insertion holes formed in parallel on the top face of a base, respectively; nearly L-shaped grooves communicating with said clamp spring accommodation portions and said lead wire holding portions are provided on the side face of said base; nearly L-shaped lead fittings provided with a clamp spring on one side of the upper end of each lead fitting are press-fitted into said L-shaped grooves sideways; by inserting lead wires inserted through said lead wire insertion holes into the connection holes in said clamp springs while operating said clamp springs with an operation rod inserted into each of said operation rod insertion holes, each of said lead wires is held between said lead fitting and said clamp spring by the spring force of said clamp spring to establish electrical connection, said electrical device connection terminal is characterized in that said lead wire holding portion is enclosed with side walls each having a flat and nearly square shape and projecting along the bottom face fringe of said lead wire holding portion.

5. An electrical device connection terminal in accordance with any one of claims 1 to 4, wherein assembly-use hold holes formed near the upper end of said lead fitting are blocked with said side wall projecting along the bottom face fringe of said lead wire holding portion.

* * * * *